US010116099B2

(12) United States Patent
Hanson et al.

(10) Patent No.: US 10,116,099 B2
(45) **Date of Patent: *Oct. 30, 2018**

(54) DEVICES FOR BIASINGLY MAINTAINING A PORT GROUND PATH

(71) Applicant: PPC BROADBAND, INC., East Syracuse, NY (US)

(72) Inventors: Brian K. Hanson, Cicero, NY (US); Noah P. Montena, Syracuse, NY (US)

(73) Assignee: PPC BROADBAND, INC., East Syracuse, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/397,222

(22) Filed: Jan. 3, 2017

(65) Prior Publication Data

US 2017/0201047 A1 Jul. 13, 2017

Related U.S. Application Data

(63) Continuation of application No. 14/867,126, filed on Sep. 28, 2015, now Pat. No. 9,537,232, which is a continuation of application No. 13/661,288, filed on Oct. 26, 2012, now Pat. No. 9,147,955.

(60) Provisional application No. 61/554,572, filed on Nov. 2, 2011.

(51) Int. Cl.

| | |
|---|---|
| ***H01R 13/6583*** | (2011.01) |
| ***H01R 13/6591*** | (2011.01) |
| ***H01R 24/54*** | (2011.01) |
| ***H01R 4/48*** | (2006.01) |
| *H01R 103/00* | (2006.01) |

(52) U.S. Cl.

CPC ..... *H01R 13/6591* (2013.01); *H01R 4/4863* (2013.01); *H01R 24/542* (2013.01); *H01R 2103/00* (2013.01)

(58) Field of Classification Search

CPC ..... H01R 13/6591; H01R 4/4863; H01R 24/542; H01R 2103/00

USPC ..... 439/578

See application file for complete search history.

(56) References Cited

U.S. PATENT DOCUMENTS

| | | | |
|---|---|---|---|
| 1,371,742 | A | 3/1921 | Dringman |
| 1,667,485 | A | 4/1928 | Macdonald |
| 1,766,869 | A | 6/1930 | Austin |
| 1,801,999 | A | 4/1931 | Bowman |
| 1,885,761 | A | 11/1932 | Peirce, Jr. |
| 2,102,495 | A | 12/1937 | England |

(Continued)

FOREIGN PATENT DOCUMENTS

| | | | |
|---|---|---|---|
| CA | 2096710 | A1 | 11/1994 |
| CN | 201149936 | Y | 11/2008 |

(Continued)

OTHER PUBLICATIONS

Digicon AVL Connector. ARRIS Group Inc. [online]. 3 pages. [retrieved on Apr. 22, 2010]. Retrieved from the Internet<URL:http://www.arrisi.com/special/digiconAVLasp>.

*Primary Examiner* — Harshad C Patel
(74) *Attorney, Agent, or Firm* — Oliff PLC

(57) ABSTRACT

A coaxial cable connector includes a connector body having a longitudinal axis passing through first and second opposed body ends, a connector center conductor for transporting a signal through the connector, and a coil spring that is coiled about the longitudinal axis. The second body end is for engaging a male coaxial cable connector, and the coil spring urges an electromagnetic shield to protrude from the second body end.

63 Claims, 8 Drawing Sheets

(56) References Cited

U.S. PATENT DOCUMENTS

| | | | |
|---|---|---|---|
| 2,258,737 | A | 10/1941 | Browne |
| 2,325,549 | A | 7/1943 | Ryzowitz |
| 2,480,963 | A | 9/1949 | Quinn |
| 2,544,654 | A | 3/1951 | Brown |
| 2,549,647 | A | 4/1951 | Turene |
| 2,694,187 | A | 11/1954 | Nash |
| 2,754,487 | A | 7/1956 | Carr et al. |
| 2,755,331 | A | 7/1956 | Melcher |
| 2,757,351 | A | 7/1956 | Klostermann |
| 2,762,025 | A | 9/1956 | Melcher |
| 2,805,399 | A | 9/1957 | Leeper |
| 2,870,420 | A | 1/1959 | Malek |
| 3,001,169 | A | 9/1961 | Blonder |
| 3,015,794 | A | 1/1962 | Kishbaugh |
| 3,091,748 | A | 5/1963 | Takes et al. |
| 3,094,364 | A | 6/1963 | Lingg |
| 3,184,706 | A | 5/1965 | Atkins |
| 3,194,292 | A | 7/1965 | Borowsky |
| 3,196,382 | A | 7/1965 | Morello, Jr. |
| 3,245,027 | A | 4/1966 | Ziegler, Jr. |
| 3,275,913 | A | 9/1966 | Blanchard |
| 3,278,890 | A | 10/1966 | Cooney |
| 3,281,757 | A | 10/1966 | Bonhomme |
| 3,292,136 | A | 12/1966 | Somerset |
| 3,320,575 | A | 5/1967 | Brown et al. |
| 3,321,732 | A | 5/1967 | Forney, Jr. |
| 3,336,563 | A | 8/1967 | Hyslop |
| 3,348,186 | A | 10/1967 | Rosen |
| 3,350,677 | A | 10/1967 | Daum |
| 3,355,698 | A | 11/1967 | Keller |
| 3,373,243 | A | 3/1968 | Janowiak |
| 3,390,374 | A | 6/1968 | Forney, Jr. |
| 3,406,373 | A | 10/1968 | Forney, Jr. |
| 3,430,184 | A | 2/1969 | Acord |
| 3,448,430 | A | 6/1969 | Kelly |
| 3,453,376 | A | 7/1969 | Ziegler, Jr. et al. |
| 3,465,281 | A | 9/1969 | Florer |
| 3,475,545 | A | 10/1969 | Stark |
| 3,494,400 | A | 2/1970 | McCoy et al. |
| 3,498,647 | A | 3/1970 | Schroder |
| 3,501,737 | A | 3/1970 | Harris et al. |
| 3,517,373 | A | 6/1970 | Jamon |
| 3,526,871 | A | 9/1970 | Hobart |
| 3,533,051 | A | 10/1970 | Ziegler, Jr. |
| 3,537,065 | A | 10/1970 | Winston |
| 3,544,705 | A | 12/1970 | Winston |
| 3,551,882 | A | 12/1970 | O'Keefe |
| 3,564,487 | A | 2/1971 | Upstone |
| 3,587,033 | A | 6/1971 | Brorein et al. |
| 3,591,748 | A | 7/1971 | Holden |
| 3,601,776 | A | 8/1971 | Curl |
| 3,629,792 | A | 12/1971 | Dorrell |
| 3,633,150 | A | 1/1972 | Swartz |
| 3,646,502 | A | 2/1972 | Hutter et al. |
| 3,663,926 | A | 5/1972 | Brandt |
| 3,665,371 | A | 5/1972 | Cripps |
| 3,668,612 | A | 6/1972 | Nepovim |
| 3,669,472 | A | 6/1972 | Nadsady |
| 3,671,922 | A | 6/1972 | Zerlin et al. |
| 3,678,444 | A | 7/1972 | Stevens et al. |
| 3,678,445 | A | 7/1972 | Brancaleone |
| 3,680,034 | A | 7/1972 | Chow et al. |
| 3,681,739 | A | 8/1972 | Kornick |
| 3,683,320 | A | 8/1972 | Woods et al. |
| 3,686,623 | A | 8/1972 | Nijman |
| 3,694,792 | A | 9/1972 | Wallo |
| 3,706,958 | A | 12/1972 | Blanchenot |
| 3,710,005 | A | 1/1973 | French |
| 3,739,076 | A | 6/1973 | Schwartz |
| 3,744,007 | A | 7/1973 | Horak |
| 3,744,011 | A | 7/1973 | Blanchenot |
| 3,778,535 | A | 12/1973 | Forney, Jr. |
| 3,781,762 | A | 12/1973 | Quackenbush |
| 3,781,898 | A | 12/1973 | Holloway |
| 3,793,610 | A | 2/1974 | Brishka |
| 3,798,589 | A | 3/1974 | Deardurff |
| 3,808,580 | A | 4/1974 | Johnson |
| 3,810,076 | A | 5/1974 | Hutter |
| 3,835,443 | A | 9/1974 | Arnold et al. |
| 3,836,700 | A | 9/1974 | Niemeyer |
| 3,845,453 | A | 10/1974 | Hemmer |
| 3,846,738 | A | 11/1974 | Nepovim |
| 3,854,003 | A | 12/1974 | Duret |
| 3,858,156 | A | 12/1974 | Zarro |
| 3,879,102 | A | 4/1975 | Horak |
| 3,886,301 | A | 5/1975 | Cronin et al. |
| 3,907,399 | A | 9/1975 | Spinner |
| 3,910,673 | A | 10/1975 | Stokes |
| 3,915,539 | A | 10/1975 | Collins |
| 3,936,132 | A | 2/1976 | Hutter |
| 3,953,097 | A | 4/1976 | Graham |
| 3,960,428 | A | 6/1976 | Naus et al. |
| 3,963,320 | A | 6/1976 | Spinner |
| 3,963,321 | A | 6/1976 | Burger et al. |
| 3,970,355 | A | 7/1976 | Pitschi |
| 3,972,013 | A | 7/1976 | Shapiro |
| 3,976,352 | A | 8/1976 | Spinner |
| 3,980,805 | A | 9/1976 | Lipari |
| 3,985,418 | A | 10/1976 | Spinner |
| 4,017,139 | A | 4/1977 | Nelson |
| 4,022,966 | A | 5/1977 | Gajajiva |
| 4,030,798 | A | 6/1977 | Paoli |
| 4,046,451 | A | 9/1977 | Juds et al. |
| 4,053,200 | A | 10/1977 | Pugner |
| 4,059,330 | A | 11/1977 | Shirey |
| 4,079,343 | A | 3/1978 | Nijman |
| 4,082,404 | A | 4/1978 | Flatt |
| 4,090,028 | A | 5/1978 | Vontobel |
| 4,093,335 | A | 6/1978 | Schwartz et al. |
| 4,106,839 | A | 8/1978 | Cooper |
| 4,109,126 | A | 8/1978 | Halbeck |
| 4,125,308 | A | 11/1978 | Schilling |
| 4,126,372 | A | 11/1978 | Hashimoto et al. |
| 4,131,332 | A | 12/1978 | Hogendobler et al. |
| 4,150,250 | A | 4/1979 | Lundeberg |
| 4,153,320 | A | 5/1979 | Townshend |
| 4,156,554 | A | 5/1979 | Aujla |
| 4,165,911 | A | 8/1979 | Laudig |
| 4,168,921 | A | 9/1979 | Blanchard |
| 4,173,385 | A | 11/1979 | Fenn et al. |
| 4,174,875 | A | 11/1979 | Wilson et al. |
| 4,187,481 | A | 2/1980 | Boutros |
| 4,225,162 | A | 9/1980 | Dola |
| 4,227,765 | A | 10/1980 | Neumann et al. |
| 4,229,714 | A | 10/1980 | Yu |
| 4,250,348 | A | 2/1981 | Kitagawa |
| 4,280,749 | A | 7/1981 | Hemmer |
| 4,285,564 | A | 8/1981 | Spinner |
| 4,290,663 | A | 9/1981 | Fowler et al. |
| 4,296,986 | A | 10/1981 | Herrmann, Jr. |
| 4,307,926 | A | 12/1981 | Smith |
| 4,322,121 | A | 3/1982 | Riches et al. |
| 4,326,769 | A | 4/1982 | Dorsey et al. |
| 4,339,166 | A | 7/1982 | Dayton |
| 4,346,958 | A | 8/1982 | Blanchard |
| 4,354,721 | A | 10/1982 | Luzzi |
| 4,358,174 | A | 11/1982 | Dreyer |
| 4,373,767 | A | 2/1983 | Cairns |
| 4,389,081 | A | 6/1983 | Gallusser et al. |
| 4,400,050 | A | 8/1983 | Hayward |
| 4,407,529 | A | 10/1983 | Holman |
| 4,408,821 | A | 10/1983 | Forney, Jr. |
| 4,408,822 | A | 10/1983 | Nikitas |
| 4,412,717 | A | 11/1983 | Monroe |
| 4,421,377 | A | 12/1983 | Spinner |
| 4,426,127 | A | 1/1984 | Kubota |
| 4,444,453 | A | 4/1984 | Kirby et al. |
| 4,452,503 | A | 6/1984 | Forney, Jr. |
| 4,456,323 | A | 6/1984 | Pitcher |
| 4,462,653 | A | 7/1984 | Flederbach et al. |
| 4,464,000 | A | 8/1984 | Werth et al. |
| 4,464,001 | A | 8/1984 | Collins |
| 4,469,386 | A | 9/1984 | Ackerman |
| 4,470,657 | A | 9/1984 | Deacon |

(56) References Cited

U.S. PATENT DOCUMENTS 4,484,792 A 11/1984 Tengler et al.
4,484,796 A 11/1984 Sato et al.
4,490,576 A 12/1984 Bolante et al.
4,506,943 A 3/1985 Drogo et al.
4,515,427 A 5/1985 Smit
4,525,017 A 6/1985 Schildkraut et al.
4,531,790 A 7/1985 Selvin
4,531,805 A 7/1985 Werth
4,533,191 A 8/1985 Blackwood
4,540,231 A 9/1985 Forney, Jr.
RE31,995 E 10/1985 Ball
4,545,637 A 10/1985 Bosshard et al.
4,575,274 A 3/1986 Hayward
4,580,862 A 4/1986 Johnson
4,580,865 A 4/1986 Fryberger
4,583,811 A 4/1986 McMills
4,585,289 A 4/1986 Bocher
4,588,246 A 5/1986 Schildkraut et al.
4,593,964 A 6/1986 Forney, Jr. et al.
4,596,434 A 6/1986 Saba et al.
4,596,435 A 6/1986 Bickford
4,597,621 A 7/1986 Burns
4,598,959 A 7/1986 Selvin
4,598,961 A 7/1986 Cohen
4,600,263 A 7/1986 DeChamp et al.
4,613,199 A 9/1986 McGeary
4,614,390 A 9/1986 Baker
4,616,900 A 10/1986 Cairns
4,632,487 A 12/1986 Wargula
4,634,213 A 1/1987 Larsson et al.
4,640,572 A 2/1987 Conlon
4,645,281 A 2/1987 Burger
4,650,228 A 3/1987 McMills et al.
4,655,159 A 4/1987 McMills
4,655,534 A 4/1987 Stursa
4,660,921 A 4/1987 Hauver
4,668,043 A 5/1987 Saba et al.
4,673,236 A 6/1987 Musolff et al.
4,674,818 A 6/1987 McMills et al.
4,676,577 A 6/1987 Szegda
4,682,832 A 7/1987 Punako et al.
4,684,201 A 8/1987 Hutter
4,688,876 A 8/1987 Morelli
4,688,878 A 8/1987 Cohen et al.
4,690,482 A 9/1987 Chamberland et al.
4,691,976 A 9/1987 Cowen
4,703,987 A 11/1987 Gallusser et al.
4,703,988 A 11/1987 Raux et al.
4,717,355 A 1/1988 Mattis
4,720,155 A 1/1988 Schildkraut et al.
4,734,050 A 3/1988 Negre et al.
4,734,666 A 3/1988 Ohya et al.
4,737,123 A 4/1988 Paler et al.
4,738,009 A 4/1988 Down et al.
4,738,628 A 4/1988 Rees
4,746,305 A 5/1988 Nomura
4,747,786 A 5/1988 Hayashi et al.
4,749,821 A 6/1988 Linton et al.
4,755,152 A 7/1988 Elliot et al.
4,757,297 A 7/1988 Frawley
4,759,729 A 7/1988 Kemppainen et al.
4,761,146 A 8/1988 Sohoel
4,772,222 A 9/1988 Laudig et al.
4,789,355 A 12/1988 Lee
4,797,120 A 1/1989 Ulery
4,806,116 A 2/1989 Ackerman
4,807,891 A 2/1989 Neher
4,808,128 A 2/1989 Werth
4,813,886 A 3/1989 Roos et al.
4,820,185 A 4/1989 Moulin
4,834,675 A 5/1989 Samchisen
4,835,342 A 5/1989 Guginsky
4,836,801 A 6/1989 Ramirez
4,838,813 A 6/1989 Pauza et al.
4,854,893 A 8/1989 Morris
4,857,014 A 8/1989 Alf et al.
4,867,706 A 9/1989 Tang
4,869,679 A 9/1989 Szegda
4,874,331 A 10/1989 Iverson
4,892,275 A 1/1990 Szegda
4,902,246 A 2/1990 Samchisen
4,906,207 A 3/1990 Banning et al.
4,915,651 A 4/1990 Bout
4,921,447 A 5/1990 Capp et al.
4,923,412 A 5/1990 Morris
4,925,403 A 5/1990 Zorzy
4,927,385 A 5/1990 Cheng
4,929,188 A 5/1990 Lionetto et al.
4,934,960 A 6/1990 Capp et al.
4,938,718 A 7/1990 Guendel
4,941,846 A 7/1990 Guimond et al.
4,952,174 A 8/1990 Sucht et al.
4,957,456 A 9/1990 Olson et al.
4,973,265 A 11/1990 Heeren
4,979,911 A 12/1990 Spencer
4,990,104 A 2/1991 Schieferly
4,990,105 A 2/1991 Karlovich
4,990,106 A 2/1991 Szegda
4,992,061 A 2/1991 Brush, Jr. et al.
5,002,503 A 3/1991 Campbell et al.
5,007,861 A 4/1991 Stirling
5,011,422 A 4/1991 Yeh
5,011,432 A 4/1991 Sucht et al.
5,021,010 A 6/1991 Wright
5,024,606 A 6/1991 Ming-Hwa
5,030,126 A 7/1991 Hanlon
5,037,328 A 8/1991 Karlovich
5,046,964 A 9/1991 Welsh et al.
5,052,947 A 10/1991 Brodie et al.
5,055,060 A 10/1991 Down et al.
5,059,747 A 10/1991 Bawa et al.
5,062,804 A 11/1991 Jamet et al.
5,066,248 A 11/1991 Gaver, Jr. et al.
5,073,129 A 12/1991 Szegda
5,080,600 A 1/1992 Baker et al.
5,083,943 A 1/1992 Tarrant
5,120,260 A 6/1992 Jackson
5,127,853 A 7/1992 McMills et al.
5,131,862 A 7/1992 Gershfeld
5,137,470 A 8/1992 Doles
5,137,471 A 8/1992 Verespej et al.
5,141,448 A 8/1992 Mattingly et al.
5,141,451 A 8/1992 Down
5,149,274 A 9/1992 Gallusser et al.
5,154,636 A 10/1992 Vaccaro et al.
5,161,993 A 11/1992 Leibfried, Jr.
5,166,477 A 11/1992 Perin, Jr. et al.
5,169,323 A 12/1992 Kawai et al.
5,181,161 A 1/1993 Hirose et al.
5,183,417 A 2/1993 Bools
5,186,501 A 2/1993 Mano
5,186,655 A 2/1993 Glenday et al.
5,195,905 A 3/1993 Pesci
5,195,906 A 3/1993 Szegda
5,205,547 A 4/1993 Mattingly
5,205,761 A 4/1993 Nilsson
5,207,602 A 5/1993 McMills et al.
5,215,477 A 6/1993 Weber et al.
5,217,391 A 6/1993 Fisher, Jr.
5,217,393 A 6/1993 Del Negro et al.
5,221,216 A 6/1993 Gabany et al.
5,227,587 A 7/1993 Paterek
5,247,424 A 9/1993 Harris et al.
5,269,701 A 12/1993 Leibfried, Jr.
5,283,853 A 2/1994 Szegda
5,284,449 A 2/1994 Vaccaro
5,294,864 A 3/1994 Do
5,295,864 A 3/1994 Birch et al.
5,316,494 A 5/1994 Flanagan et al.
5,318,459 A 6/1994 Shields
5,334,032 A 8/1994 Myers et al.
5,334,051 A 8/1994 Devine et al.
5,338,225 A 8/1994 Jacobsen et al.
5,342,218 A 8/1994 McMills et al.

(56) References Cited

U.S. PATENT DOCUMENTS 5,354,217 A 10/1994 Gabel et al.
5,362,250 A 11/1994 McMills et al.
5,371,819 A 12/1994 Szegda
5,371,821 A 12/1994 Szegda
5,371,827 A 12/1994 Szegda
5,380,211 A 1/1995 Kawaguchi et al.
5,389,005 A 2/1995 Kodama
5,393,244 A 2/1995 Szegda
5,397,252 A 3/1995 Wang
5,413,504 A 5/1995 Kloecker et al.
5,431,583 A 7/1995 Szegda
5,435,745 A 7/1995 Booth
5,439,386 A 8/1995 Ellis et al.
5,444,810 A 8/1995 Szegda
5,455,548 A 10/1995 Grandchamp et al.
5,456,611 A 10/1995 Henry et al.
5,456,614 A 10/1995 Szegda
5,466,173 A 11/1995 Down
5,470,257 A 11/1995 Szegda
5,474,478 A 12/1995 Ballog
5,490,033 A 2/1996 Cronin
5,490,801 A 2/1996 Fisher, Jr. et al.
5,494,454 A 2/1996 Johnsen
5,499,934 A 3/1996 Jacobsen et al.
5,501,616 A 3/1996 Holliday
5,516,303 A 5/1996 Yohn et al.
5,525,076 A 6/1996 Down
5,542,861 A 8/1996 Anhalt et al.
5,548,088 A 8/1996 Gray et al.
5,550,521 A 8/1996 Bernaud et al.
5,564,938 A 10/1996 Shenkal et al.
5,571,028 A 11/1996 Szegda
5,586,910 A 12/1996 Del Negro et al.
5,595,499 A 1/1997 Zander et al.
5,598,132 A 1/1997 Stabile
5,607,325 A 3/1997 Toma
5,620,339 A 4/1997 Gray et al.
5,632,637 A 5/1997 Diener
5,632,651 A 5/1997 Szegda
5,644,104 A 7/1997 Porter et al.
5,651,698 A 7/1997 Locati et al.
5,651,699 A 7/1997 Holliday
5,653,605 A 8/1997 Woehl et al.
5,667,405 A 9/1997 Holliday
5,681,172 A 10/1997 Moldenhauer
5,683,263 A 11/1997 Hsu
5,702,263 A 12/1997 Baumann et al.
5,722,856 A 3/1998 Fuchs et al.
5,735,704 A 4/1998 Anthony
5,746,617 A 5/1998 Porter, Jr. et al.
5,746,619 A 5/1998 Harting et al.
5,769,652 A 6/1998 Wider
5,775,927 A 7/1998 Wider
5,863,220 A 1/1999 Holliday
5,877,452 A 3/1999 McConnell
5,879,191 A 3/1999 Burris
5,882,226 A 3/1999 Bell et al.
5,921,793 A 7/1999 Phillips
5,938,465 A 8/1999 Fox, Sr.
5,944,548 A 8/1999 Saito
5,957,716 A 9/1999 Buckley et al.
5,967,852 A 10/1999 Follingstad et al.
5,975,949 A 11/1999 Holliday et al.
5,975,951 A 11/1999 Burris et al.
5,977,841 A 11/1999 Lee et al.
5,997,350 A 12/1999 Burris et al.
6,010,349 A 1/2000 Porter, Jr.
6,019,635 A 2/2000 Nelson
6,022,237 A 2/2000 Esh
6,032,358 A 3/2000 Wild
6,042,422 A 3/2000 Youtsey
6,048,229 A 4/2000 Lazaro, Jr.
6,053,769 A 4/2000 Kubota et al.
6,053,777 A 4/2000 Boyle
6,083,053 A 7/2000 Anderson, Jr. et al.
6,089,903 A 7/2000 Stafford Gray et al.
6,089,912 A 7/2000 Tallis et al.
6,089,913 A 7/2000 Holliday
6,123,567 A 9/2000 McCarthy
6,146,197 A 11/2000 Holliday et al.
6,152,753 A 11/2000 Johnson et al.
6,153,830 A 11/2000 Montena
6,210,216 B1 4/2001 Tso-Chin et al.
6,210,222 B1 4/2001 Langham et al.
6,217,383 B1 4/2001 Holland et al.
6,239,359 B1 5/2001 Lilienthal, II et al.
6,241,553 B1 6/2001 Hsia
6,261,126 B1 7/2001 Stirling
6,267,612 B1 7/2001 Arcykiewicz et al.
6,271,464 B1 8/2001 Cunningham
6,331,123 B1 12/2001 Rodrigues
6,332,815 B1 12/2001 Bruce
6,358,077 B1 3/2002 Young
D458,904 S 6/2002 Montena
6,406,330 B2 6/2002 Bruce
D460,739 S 7/2002 Fox
D460,740 S 7/2002 Montena
D460,946 S 7/2002 Montena
D460,947 S 7/2002 Montena
D460,948 S 7/2002 Montena
6,422,900 B1 7/2002 Hogan
6,425,782 B1 7/2002 Holland
D461,166 S 8/2002 Montena
D461,167 S 8/2002 Montena
D461,778 S 8/2002 Fox
D462,058 S 8/2002 Montena
D462,060 S 8/2002 Fox
6,439,899 B1 8/2002 Muzslay et al.
D462,327 S 9/2002 Montena
6,468,100 B1 10/2002 Meyer et al.
6,491,546 B1 12/2002 Perry
D468,696 S 1/2003 Montena
6,506,083 B1 1/2003 Bickford et al.
6,530,807 B2 3/2003 Rodrigues et al.
6,540,531 B2 4/2003 Syed et al.
6,558,194 B2 5/2003 Montena
6,572,419 B2 6/2003 Feye-Homann
6,576,833 B2 6/2003 Covaro et al.
6,619,876 B2 9/2003 Vaitkus et al.
6,634,906 B1 10/2003 Yeh
6,676,446 B2 1/2004 Montena
6,683,253 B1 1/2004 Lee
6,692,285 B2 2/2004 Islam
6,692,286 B1 2/2004 De Cet
6,712,631 B1 3/2004 Youtsey
6,716,041 B2 4/2004 Ferderer et al.
6,716,062 B1 4/2004 Palinkas et al.
6,733,336 B1 5/2004 Montena et al.
6,733,337 B2 5/2004 Kodaira
6,767,248 B1 7/2004 Hung
6,769,926 B1 8/2004 Montena
6,780,068 B2 8/2004 Bartholoma et al.
6,786,767 B1 9/2004 Fuks et al.
6,790,081 B2 9/2004 Burris et al.
6,805,584 B1 10/2004 Chen
6,817,896 B2 11/2004 Derenthal
6,848,939 B2 2/2005 Stirling
6,848,940 B2 2/2005 Montena
6,884,113 B1 4/2005 Montena
6,884,115 B2 4/2005 Malloy
6,929,508 B1 8/2005 Holland
6,939,169 B2 9/2005 Islam et al.
6,971,912 B2 12/2005 Montena et al.
7,029,326 B2 4/2006 Montena
7,070,447 B1 7/2006 Montena
7,086,897 B2 8/2006 Montena
7,097,499 B1 8/2006 Purdy
7,102,868 B2 9/2006 Montena
7,114,990 B2 10/2006 Bence et al.
7,118,416 B2 10/2006 Montena et al.
7,125,283 B1 10/2006 Lin
7,131,868 B2 11/2006 Montena
7,144,271 B1 12/2006 Burris et al.
7,147,509 B1 12/2006 Burris et al.

(56) References Cited

U.S. PATENT DOCUMENTS

| | | | |
|---|---|---|---|
| 7,156,696 | B1 | 1/2007 | Montena |
| 7,161,785 | B2 | 1/2007 | Chawgo |
| 7,179,121 | B1 | 2/2007 | Burris et al. |
| 7,229,303 | B2 | 6/2007 | Vermoesen et al. |
| 7,252,546 | B1 | 8/2007 | Holland |
| 7,255,598 | B2 | 8/2007 | Montena et al. |
| 7,299,550 | B2 | 11/2007 | Montena |
| 7,375,533 | B2 | 5/2008 | Gale |
| 7,393,245 | B2 | 7/2008 | Palinkas et al. |
| 7,404,737 | B1 | 7/2008 | Youtsey |
| 7,452,239 | B2 | 11/2008 | Montena |
| 7,455,550 | B1 | 11/2008 | Sykes |
| 7,462,068 | B2 | 12/2008 | Amidon |
| 7,476,127 | B1 | 1/2009 | Wei |
| 7,479,035 | B2 | 1/2009 | Bence et al. |
| 7,488,210 | B1 | 2/2009 | Burris et al. |
| 7,494,355 | B2 | 2/2009 | Hughes et al. |
| 7,497,729 | B1 | 3/2009 | Wei |
| 7,507,117 | B2 | 3/2009 | Amidon |
| 7,544,094 | B1 | 6/2009 | Paglia et al. |
| 7,566,236 | B2 | 7/2009 | Malloy et al. |
| 7,607,942 | B1 | 10/2009 | Van Swearingen |
| 7,674,132 | B1 | 3/2010 | Chen |
| 7,682,177 | B2 | 3/2010 | Berthet |
| 7,727,011 | B2 | 6/2010 | Montena et al. |
| 7,753,705 | B2 | 7/2010 | Montena |
| 7,753,727 | B1 | 7/2010 | Islam et al. |
| 7,794,275 | B2 | 9/2010 | Rodrigues |
| 7,806,714 | B2 | 10/2010 | Williams et al. |
| 7,806,725 | B1 | 10/2010 | Chen |
| 7,811,133 | B2 | 10/2010 | Gray |
| 7,824,216 | B2 | 11/2010 | Purdy |
| 7,828,595 | B2 | 11/2010 | Mathews |
| 7,830,154 | B2 | 11/2010 | Gale |
| 7,833,053 | B2 | 11/2010 | Mathews |
| 7,845,976 | B2 | 12/2010 | Mathews |
| 7,845,978 | B1 | 12/2010 | Chen |
| 7,850,487 | B1 | 12/2010 | Wei |
| 7,857,661 | B1 | 12/2010 | Islam |
| 7,887,354 | B2 | 2/2011 | Holliday |
| 7,892,004 | B2 | 2/2011 | Hertzler et al. |
| 7,892,005 | B2 | 2/2011 | Haube |
| 7,892,024 | B1 | 2/2011 | Chen |
| 7,927,135 | B1 | 4/2011 | Wlos |
| 7,950,958 | B2 | 5/2011 | Mathews |
| 7,955,126 | B2 | 6/2011 | Bence et al. |
| 7,972,158 | B2 | 7/2011 | Wild et al. |
| 8,029,315 | B2 | 10/2011 | Purdy et al. |
| 8,062,044 | B2 | 11/2011 | Montena et al. |
| 8,062,063 | B2 | 11/2011 | Malloy et al. |
| 8,075,337 | B2 | 12/2011 | Malloy et al. |
| 8,113,875 | B2 | 2/2012 | Malloy et al. |
| 8,172,612 | B2 | 5/2012 | Bence et al. |
| 8,192,237 | B2 | 6/2012 | Purdy et al. |
| 8,287,320 | B2 | 10/2012 | Purdy et al. |
| 8,313,345 | B2 | 11/2012 | Purdy |
| 8,313,353 | B2 | 11/2012 | Purdy et al. |
| 8,323,060 | B2 | 12/2012 | Purdy et al. |
| 8,777,658 | B2 | 7/2014 | Holland et al. |
| 8,888,527 | B2 | 11/2014 | Chastain et al. |
| 9,112,323 | B2 | 8/2015 | Goebel et al. |
| 9,136,629 | B2 | 9/2015 | Holland |
| 2002/0013088 | A1 | 1/2002 | Rodrigues et al. |
| 2002/0038720 | A1 | 4/2002 | Kai et al. |
| 2003/0214370 | A1 | 11/2003 | Allison et al. |
| 2003/0224657 | A1 | 12/2003 | Malloy |
| 2004/0077215 | A1 | 4/2004 | Palinkas et al. |
| 2004/0102089 | A1 | 5/2004 | Chee |
| 2004/0209516 | A1 | 10/2004 | Burris et al. |
| 2004/0219833 | A1 | 11/2004 | Burris et al. |
| 2004/0229504 | A1 | 11/2004 | Liu |
| 2005/0042919 | A1 | 2/2005 | Montena |
| 2005/0208827 | A1 | 9/2005 | Burris et al. |
| 2005/0233636 | A1 | 10/2005 | Rodrigues et al. |
| 2006/0099853 | A1 | 5/2006 | Sattele et al. |
| 2006/0110977 | A1 | 5/2006 | Matthews |
| 2006/0154519 | A1 | 7/2006 | Montena |
| 2007/0026734 | A1 | 2/2007 | Bence et al. |
| 2007/0049113 | A1 | 3/2007 | Rodrigues et al. |
| 2007/0123101 | A1 | 5/2007 | Palinkas |
| 2007/0155232 | A1 | 7/2007 | Burris et al. |
| 2007/0175027 | A1 | 8/2007 | Khemakhem et al. |
| 2007/0243759 | A1 | 10/2007 | Rodrigues et al. |
| 2007/0243762 | A1 | 10/2007 | Burke et al. |
| 2008/0102696 | A1 | 5/2008 | Montena |
| 2008/0113554 | A1 | 5/2008 | Montena |
| 2008/0289470 | A1 | 11/2008 | Aston |
| 2009/0029590 | A1 | 1/2009 | Sykes et al. |
| 2009/0098770 | A1 | 4/2009 | Bence et al. |
| 2010/0055978 | A1 | 3/2010 | Montena |
| 2010/0081321 | A1 | 4/2010 | Malloy et al. |
| 2010/0081322 | A1 | 4/2010 | Malloy et al. |
| 2010/0105246 | A1 | 4/2010 | Burris et al. |
| 2010/0233901 | A1 | 9/2010 | Wild et al. |
| 2010/0233902 | A1 | 9/2010 | Youtsey |
| 2010/0255721 | A1 | 10/2010 | Purdy et al. |
| 2010/0279548 | A1 | 11/2010 | Montena et al. |
| 2010/0297871 | A1 | 11/2010 | Haube |
| 2010/0297875 | A1 | 11/2010 | Purdy et al. |
| 2011/0021072 | A1 | 1/2011 | Purdy |
| 2011/0027039 | A1 | 2/2011 | Blair |
| 2011/0053413 | A1 | 3/2011 | Mathews |
| 2011/0117774 | A1 | 5/2011 | Malloy et al. |
| 2011/0143567 | A1 | 6/2011 | Purdy et al. |
| 2011/0230089 | A1 | 9/2011 | Amidon et al. |
| 2011/0230091 | A1 | 9/2011 | Krenceski et al. |
| 2012/0071031 | A1 | 3/2012 | Rossman |
| 2012/0171894 | A1 | 7/2012 | Malloy et al. |
| 2012/0222302 | A1 | 9/2012 | Purdy et al. |
| 2012/0225581 | A1 | 9/2012 | Amidon et al. |

FOREIGN PATENT DOCUMENTS

| | | | |
|---|---|---|---|
| CN | 201149937 | Y | 11/2008 |
| CN | 201178228 | Y | 1/2009 |
| DE | 102289 | C | 7/1897 |
| DE | 1117687 | B | 11/1961 |
| DE | 1191880 | B | 4/1965 |
| DE | 047931 | C | 5/1966 |
| DE | 1515398 | B1 | 4/1970 |
| DE | 2225764 | A1 | 12/1972 |
| DE | 2221936 | A1 | 11/1973 |
| DE | 2261973 | A1 | 6/1974 |
| DE | 3211008 | A1 | 10/1983 |
| DE | 90016084 | | 4/1990 |
| DE | 4439852 | A1 | 5/1996 |
| DE | 19957518 | A1 | 9/2001 |
| EP | 0072104 | A1 | 2/1983 |
| EP | 0116157 | A1 | 8/1984 |
| EP | 0167738 | A2 | 1/1986 |
| EP | 0265276 | A2 | 4/1988 |
| EP | 0428424 | A2 | 5/1991 |
| EP | 1191268 | A1 | 3/2002 |
| EP | 1501159 | A1 | 1/2005 |
| EP | 1548898 | A1 | 6/2005 |
| EP | 1701410 | A2 | 9/2006 |
| FR | 2232846 | A1 | 1/1975 |
| FR | 2234680 | A2 | 1/1975 |
| FR | 2312918 | A1 | 12/1976 |
| FR | 2462798 | A1 | 2/1981 |
| FR | 2494508 | A1 | 5/1982 |
| GB | 0589697 | A | 6/1947 |
| GB | 1087228 | A | 10/1967 |
| GB | 1270846 | A | 4/1972 |
| GB | 1401373 | A | 7/1975 |
| GB | 2019665 | A | 10/1979 |
| GB | 2079549 | A | 1/1982 |
| GB | 2252677 | A | 8/1992 |
| GB | 2264201 | A | 8/1993 |
| GB | 2331634 | A | 5/1999 |
| JP | 2002075556 | A | 3/2002 |
| JP | 3280369 | B2 | 5/2002 |
| JP | 4503793 | B2 | 7/2010 |
| KR | 2006100622526 | | 9/2006 |

(56) References Cited

FOREIGN PATENT DOCUMENTS

| | | | |
|---|---|---|---|
| TW | 427044 | B | 3/2001 |
| WO | 8700351 | A1 | 1/1987 |
| WO | 0186756 | A1 | 11/2001 |
| WO | 02069457 | A1 | 9/2002 |
| WO | 2004013883 | A2 | 2/2004 |
| WO | 2006081141 | A1 | 8/2006 |

DEVICES FOR BIASINGLY MAINTAINING A PORT GROUND PATH

CROSS-REFERENCE TO RELATED APPLICATIONS

This is a continuation of U.S. patent application Ser. No. 14/867,126, filed Sep. 28, 2015, pending, which in turn is a continuation of U.S. patent application Ser. No. 13/661,288, filed Oct. 26, 2012, now U.S. Pat. No. 9,147,955, which claims the benefit of U.S. Provisional Application No. 61/554,572, filed on Nov. 2, 2011. The disclosure of the prior application[s] is hereby incorporated by reference herein in its entirety.

BACKGROUND

It is desirable to maintain continuity through a coaxial cable connector, which typically involves the continuous contact of conductive connector components which can prevent radio frequency (RF) leakage and ensure a stable ground connection. For example, physical contact between a nut and a post of a coaxial cable connector extends a continuous, uninterrupted ground path through the connector when the connector is mated onto a port. An additional continuity member, such as a metal spring or a metal washer, disposed within the connector is typically required to extend electrical continuity through the connector. However, not all coaxial cable connectors come equipped with the additional component required to extend electrical continuity through the connector. The absence of a continuity member within the connector adversely affects signal quality and invites RF leakage with poor RF shielding when the connector is mated onto the port.

Thus, a need exists for an apparatus and method for a port that provides continuity through a standard coaxial cable connector not having an additional continuity member.

SUMMARY

One general aspect relates to a port comprising an outer housing having a first end and a second end, the outer housing configured to terminate a coaxial cable connector at one or both of a first end and a second end, and a biasing member disposed within the outer housing to bias a post of the coaxial cable connector into contact with a coupling member of the coaxial cable connector, wherein the contact between the post and the coupling member extends continuity between the post and the coupling member.

Another general aspect relates to a port comprising an outer housing having a first end and a second end, the outer housing configured to terminate a coaxial cable connector at one or both of a first end and a second end, and a biasing member disposed within the outer housing to bias against a post of the coaxial cable, wherein the contact between the post and the biasing extends electrical continuity between the coaxial cable connector and the port.

Another general aspect relates to a port comprising an outer housing having a first portion and a second portion, a first insulator disposed within the first portion of the outer housing, a collar operably attached to the first insulator, the collar having a flange, and a biasing member disposed between the collar and a second insulator body, the biasing member configured to exert a biasing force against the collar in a first direction and against a second insulator body in a second direction when being compressed.

Another general aspect relates to a port comprising an outer housing having a first portion and a second portion, a first insulator disposed within the first portion of the outer housing, wherein a collar is operably attached to the first insulator, and a biasing member disposed within the outer housing, the biasing member biasingly engaging the collar.

Another general aspect relates to a port comprising an outer housing having a first portion and a second portion, a first moveable insulator disposed within the first portion, wherein a first collar is operably attached to the first moveable insulator, a second moveable insulator disposed within the second portion, wherein a second collar is operably attached to the second moveable insulator, and a biasing member disposed within the outer housing, the biasing member biasingly engaging the first collar and the second collar.

Another general aspect relates to a port comprising an outer housing having a first end and a second end, the outer housing configured to terminate a coaxial cable connector at one or both of a first end and a second end, and a means to extend electrical continuity between a coupling member of the coaxial cable connector and a post of the coaxial cable connector, wherein the means is disposed within the outer housing.

Another general aspect relates to a method of providing continuity to a coaxial cable connector, comprising providing an outer housing having a first end and a second end, the outer housing configured to terminate a coaxial cable connector at one or both of a first end and a second end, disposing a biasing member within the outer housing to bias at least one collar, and advancing the coaxial cable connector onto the outer housing to bring a post of the coaxial cable connector into engagement with the at least one collar, wherein the engagement between the post and the at least one collar biases the post into a coupling member of the coaxial cable connector to extend electrical continuity through the connector.

Another general aspect relates to a port for a connector having a post and a coupler. The port comprises an outer housing having a first portion and a second portion, a collar having a flange configured to engage a post of a connector, and a first insulator body disposed within the first portion and having a mating edge configured to engage the flange. The port further comprises a second insulator body having a first end and a second end and disposed within the second portion. The port further comprises a biasing member at least partially surrounding the first insulator body and configured to engage the collar at a forward end and the first end of the second insulator body at a rearward end. Engagement of the port with the connector exerts a biasing force against the collar to contact the post and to bias the post into contact with a coupler to maintain physical and electrical contact between the post and the coupler.

Another general aspect relates to a port for coupling a cable connector having a post and a coupler. The port comprises a collar configured to contact a post, a first insulator body disposed within at least a portion of the collar, a second insulator body spaced axially from the collar, and a biasing member disposed between the first insulator body and the second insulator body. The biasing member is configured to exert a biasing force against the first insulator body in one direction and against the second insulator body in another direction. The biasing force exerted against the first insulator body is transferred to a post so as to bias the post into contact with a coupler to maintain physical and electrical contact between the coupler and the post.

Another general aspect relates to a port for a connector having a post and a coupler. The port comprises a collar configured to contact a post, an insulator body spaced axially from the collar, and a biasing structure having a first end and a second end. The second end is configured to exert a biasing force against the insulator body and the first end is configured to exert a biasing force from the collar to the post of a connector when the connector is coupled to the port so as to biasingly maintain physical and electrical contact between the post and a coupler.

Still another general aspect relates to a port for biasingly maintaining an electrical ground path in a connector having a post and a coupler when the connector is coupled to the port. The port comprises a collar, an insulator body, and a biasing member configured to biasingly maintain a post and a coupler of a connector in electrical contact with one another during operation of the connector and when the connector is coupled to the port.

The foregoing and other features of construction and operation will be more readily understood and fully appreciated from the following detailed disclosure, taken in conjunction with accompanying drawings.

BRIEF DESCRIPTION OF THE DRAWINGS

Some of the embodiments will be described in detail, with reference to the following figures, wherein like designations denote like members, wherein.

DETAILED DESCRIPTION

A detailed description of the hereinafter described embodiments of the disclosed apparatus and method are presented herein by way of exemplification and not limitation with reference to the Figures. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

Figure 1:
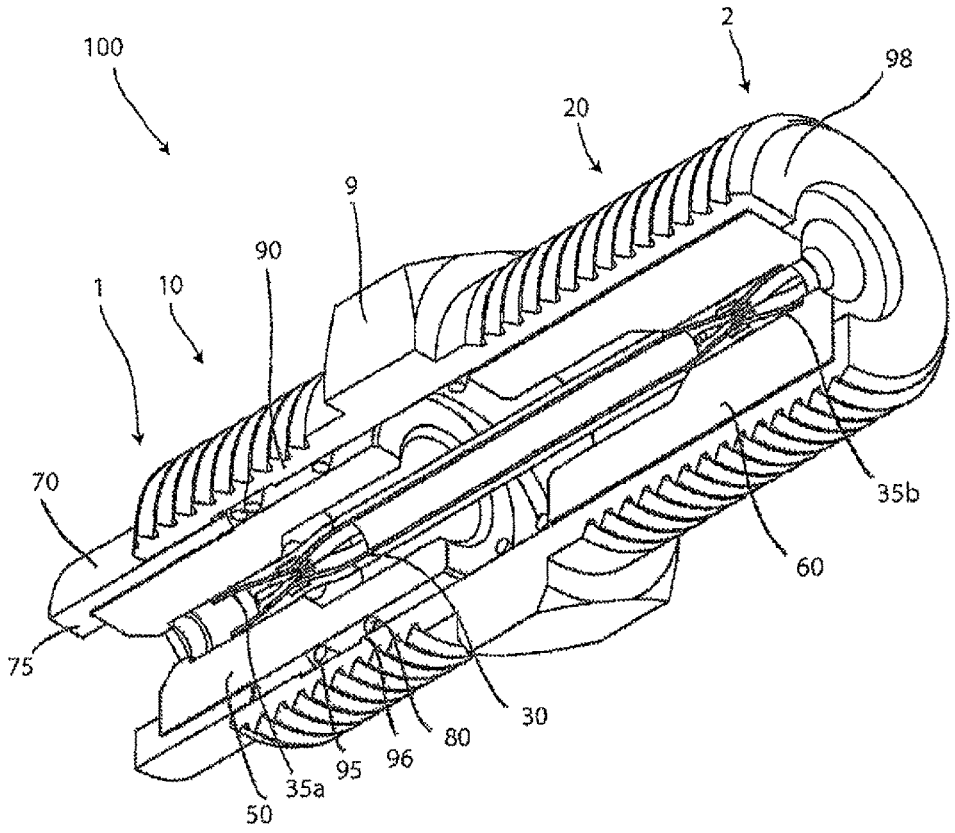
FIG. 1 depicts a perspective view of a first embodiment of a port.

Referring to the drawings, FIG. 1 depicts an embodiment of a port 100. Embodiments of port 100 may terminate a coaxial cable connector, and may be configured to extend continuity through a standard coaxial cable by biasing the post into contact with the nut when the connector is terminated at the port. Terminating a coaxial cable connector may occur when the connector is mated, threadably or otherwise, with port 100. Embodiments of port 100 may be a two-sided port, such as found in a splice, a one-sided equipment port, such as found on a cable box, an equipment port, such as found on a cell tower, or any conductive receptacle configured to mate with a coaxial cable connector and/or receive a center conductive strand of a coaxial cable. Embodiments of the port 100 may include a first end 1 and a second end 2, and may have an inner surface 3 and an outer surface 4. An annular flange portion 9 of the port 100 may be positioned between the first end 1 and the second end 2, wherein the annular flange portion 9 may be a bulkhead or other physical portion that provides separation from a first portion 10 and a second portion 20 and also may provide an edge having a larger outer diameter than the outer surface 4 of the port 100. For example, the annular flange portion 9 may separate a first portion 10, or first side, and a second portion 20, or second side. Embodiments of the first portion 10 of the port 100 may be configured to matably receive a coaxial cable connector, such as connector 1000 shown in FIG. 2. The outer surface 4 (or a portion thereof) of the port 100 may be threaded to accommodate an inner threaded surface of a coupling member 1030 of connector 1000. However, embodiments of the outer surface 4 of the port 100 may be smooth or otherwise non-threaded. In further embodiments, the second portion 20 of the port 100 may also matably receive a coaxial cable connector, such as connector 1000. It should be recognized that the radial thickness and/or the length of the port 100 and/or the conductive receptacle may vary based upon generally recognized parameters corresponding to broadband communication standards and/or equipment. Moreover, the pitch and depth of threads which may be formed upon the outer surface 4 of the coaxial cable interface port 100 may also vary based upon generally recognized parameters corresponding to broadband communication standards and/or equipment. Furthermore, it should be noted that the port 100 may be formed of a single conductive material, multiple conductive materials, or may be configured with both conductive and non-conductive materials corresponding to the port's 100 electrical interface with a coaxial cable connector, such as connector 1000. Further still, it will be understood by those of ordinary skill that the port 100 may be embodied by a connective interface component of a communications modifying device such as a signal splitter, a cable line extender, a cable network module and/or the like.

Figure 2:
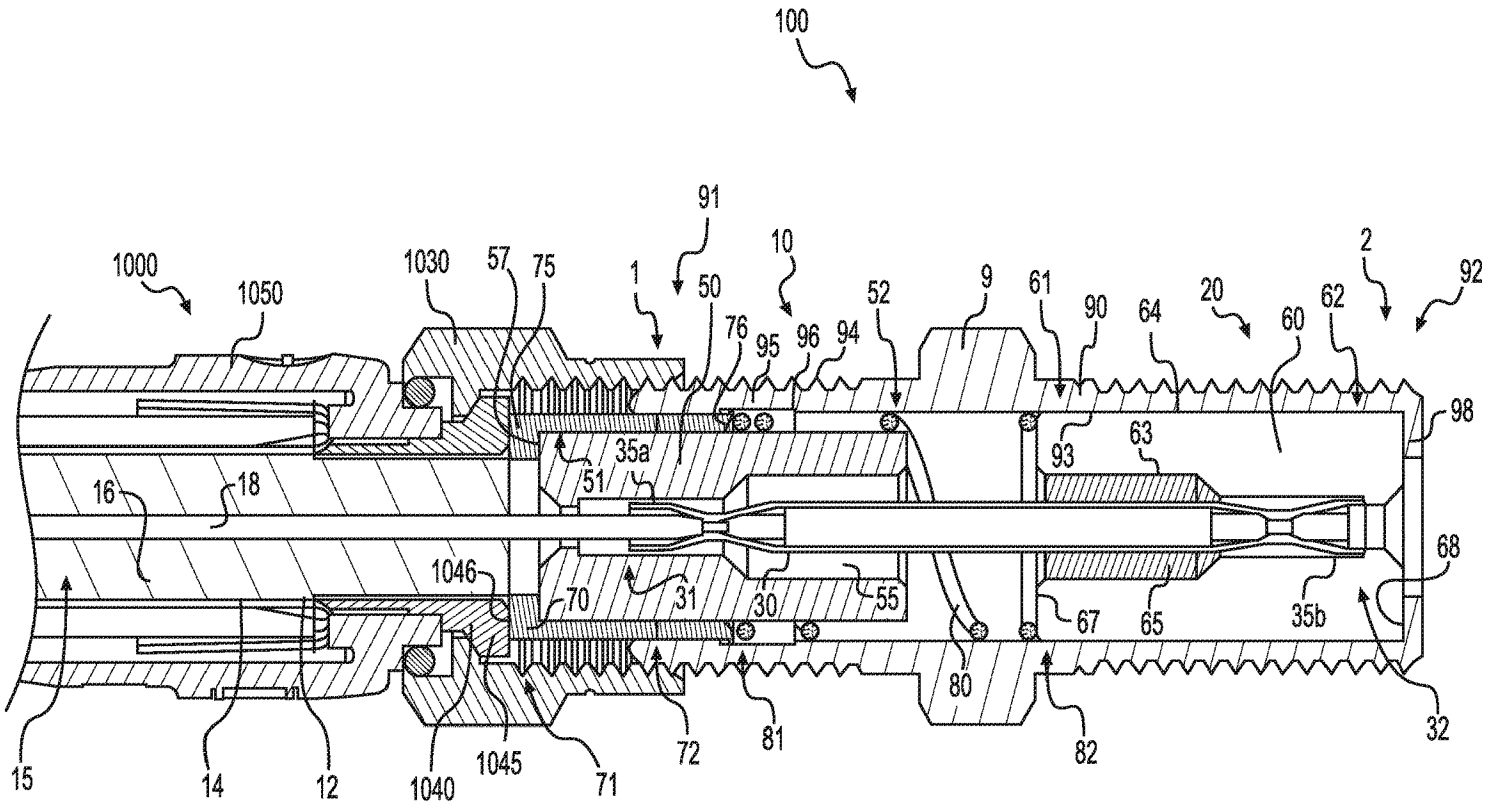
FIG. 2 depicts a cross-section view of the first embodiment of the port.

Referring still to FIG. 1, and with additional reference to FIG. 2, embodiments of port 100 may include an outer housing 90, a first insulator body 50, a second insulator body 60, an electrical contact 30, a collar 70, and a biasing member 80. Embodiments of port 100, 300 may include an outer housing 90, 390 having a first end 91, 391 and a second end 92, 392, the outer housing 90, 390 configured to terminate a coaxial cable connector 1000 at one or both of a first end 91, 391 and a second end 92, 392, and a biasing member 80, 180, 280, 380 disposed within the outer housing 90, 390 to bias a post 1040 of the coaxial cable connector 1000 into contact with a coupling member 1030 of the coaxial cable connector 1000, wherein the contact between the post 1040 and the coupling member 1030 extends continuity between the post 1040 and the coupling member 1030. Further embodiments of port 100, 300 may include an outer housing 90, 390 having a first portion 10, 310, and a second portion 320, a first insulator 50, 350 disposed within the first portion 10, 310 of the outer housing 90, 390, wherein a collar 70, 370*a* is operably attached to the first insulator 50, 350, and a biasing member 80, 180, 280, 380 disposed within the outer housing 90, 390, the biasing member 80, 180, 280, 380 biasingly engaging the collar 70, 370*a*. Even further embodiments of port 100 may include an outer housing 90 having a first portion 10 and a second portion 20, a first insulator 50 disposed within the first portion 10 of the outer housing 90, a collar 70 operably attached to the first insulator 50, the collar having a flange 75, and a biasing member 80, 180, 280 disposed between the collar 70 and a second insulator body 60, the biasing member 80, 180, 280 configured to exert a biasing force against the collar 70 in a first direction and against a second insulator body 60 in a second direction when being compressed.

FIG. 2 depicts an embodiment of a coaxial cable connector 1000. Embodiments of coaxial cable connector 1000 may be any standard coaxial cable connector which does or does not include an additional component or special structure to effectuate continuous grounding through the connector 1000. More particularly, the coaxial cable connector 1000 may be an F connector, a 75 Ohm connector, a 50 Ohm connector, a connector used in wireless applications for attachment to an equipment port on a cell tower, a connector used with broadband communications, and the like. Moreover, embodiments of a coaxial cable connector 1000 may be operably affixed to a coaxial cable 10, wherein the coaxial cable includes a center conductor 18 being surrounded by a dielectric 16, which is surrounded by an outer conductive strand 14, which is surrounded by a protective cable jacket 12. Embodiments of the coaxial cable connector 1000 may include a coupling member 1030, a post 1040, a connector body 1050, and other various components, such as a fastener or cap member. The coupling member 1030 may be operably attached to the post 1040 such that the coupling member 1030 may rotate freely about the post and ultimately thread onto or otherwise mate with the port 100. Embodiments of the coupling member 1030 can be conductive; for example, can be comprised of metal(s) to extend continuity between the post 1040 and/or the outer threads of the port 100. Other embodiments of the coupling member 1030 may be formed of plastic or similar non-metal material because electrical continuity may extend through contact the post 1040 and the port 100 (e.g. post 1040 to collar 70 or conductive insulator body 50). The post 1040 may be configured to receive a prepared end of the cable as known to those skilled in the art, and may include a flange 1045 and a mating edge 46; the mating edge 46 may be configured to engage a collar 70 as the connector 1000 is threadably or otherwise advanced onto the port 1000. The connector body 1050 can be operably attached to the post and radially surround the post 1040, as known to those having skill in the art.

Figure 6:
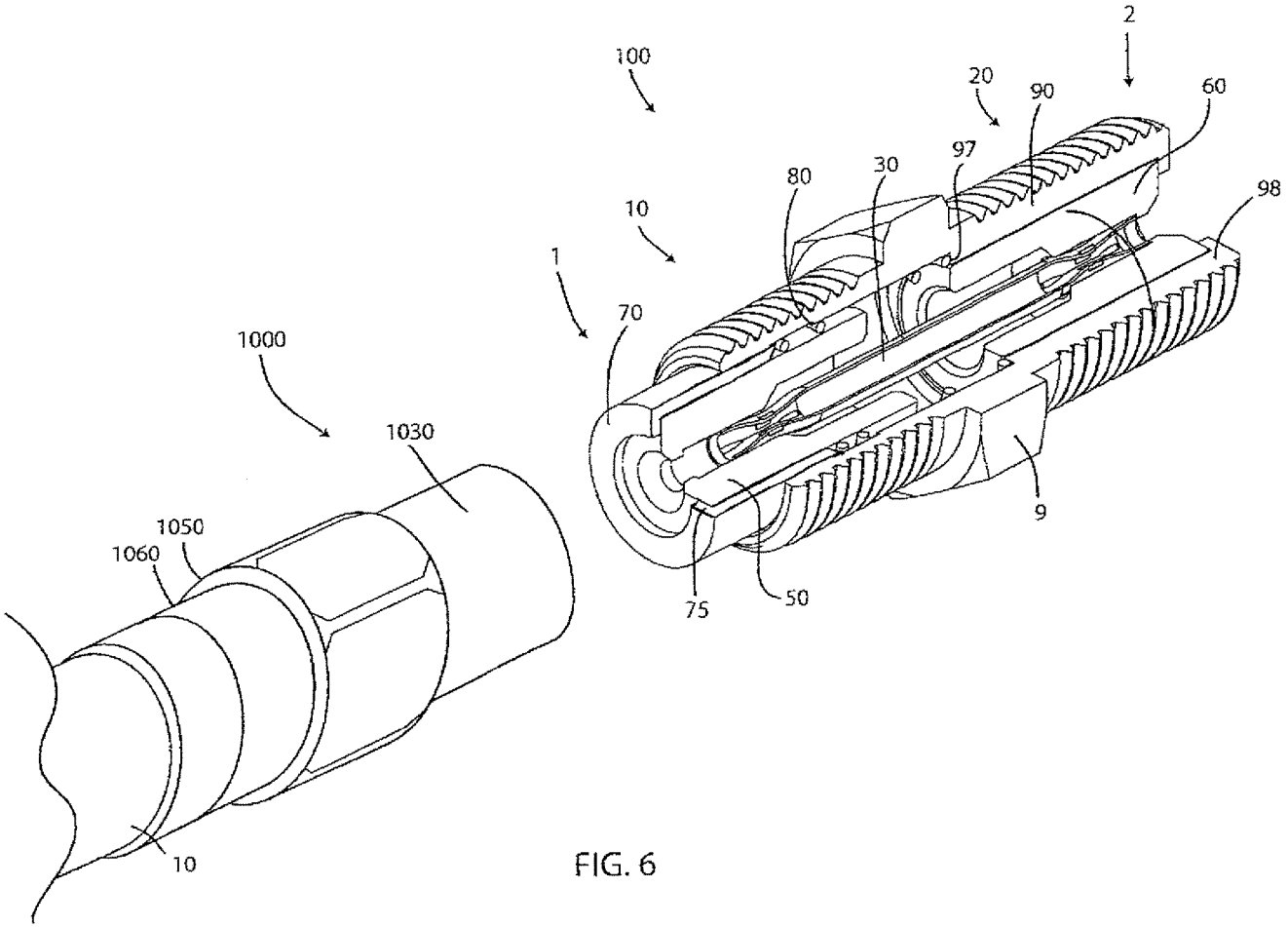
FIG. 6 depicts a cross-section view of the first embodiment of the port in an original position.

Referring again to FIG. 1, with continued reference to FIG. 2, embodiments of port 100 may include an outer housing 90. Embodiments of the outer housing 90 may include a generally axial opening therethrough to accommodate one or more components within the outer housing 90. The components disposed within the outer housing 90 may be moveable within the opening of the outer housing 90 in a generally axial direction. The outer housing 90 may have exterior threaded surface portions 94 that may correspond to a threaded inner surface of a coupler member 1030 of a coaxial cable connector 1000. The outer housing 90 may also include a first portion 10, a second portion 20, and an annular flange portion 9 that can separate the first portion 10 and the second portion 20. Embodiments of the first portion 10, the second portion 20, and the annular flange portion 9 may be structurally integral with each other forming a single, one-piece conductive component. Moreover, the outer housing 90 may include an annular recess 95 along an inner surface 93 of the outer housing 90. The annular recess 95 may be a portion of the inner surface 93 that is recessed a distance, forming an edge 96. Proximate or otherwise near the distal end of the second portion 20 (distal from the annular flange portion 9), a radially inwardly extending portion 98 may act as a stopper or other physical edge to restrain axial movement of a second insulator body 60 when biasing forces are exerted onto the second insulator body 60 during mating of the connector 1000 onto port 100. Furthermore, embodiments of outer housing 90 may include an inner annular shoulder 97, as depicted in FIG. 6. The shoulder 97 may protrude a distance from the inner surface 93 of the outer housing 90 to provide an edge for the biasing member 80 to rest on, make contact with, or bias against. The contact between the flat face of the shoulder 97 and the biasing member 80 may eliminate any grounding concerns by ensuring sufficient contact between the biasing member 80 and the outer housing 90. The outer housing 90 should be formed of metals or other conductive materials that would facilitate a rigidly formed outer shell. Manufacture of the outer housing 90 may include casting, extruding, cutting, turning, drilling, knurling, injection molding, spraying, blow molding, component overmolding, or other fabrication methods that may provide efficient production of the component.

Referring still to FIGS. 1 and 2, embodiments of the port 100 may include a first insulator body 50. Embodiments of the first insulator body 50 may be a generally annular or cylindrical tubular member, and may be disposed or otherwise located within the generally axial opening of the outer housing 90, proximate or otherwise near the first end 1 of the port 100. In other words, the first insulator body 50 may be disposed within the first portion 10 of the outer housing 90. The first insulator body 50 may include a first end 51, a second end 52, an inner surface 53, and an outer surface 54. Proximate the first end 51, the first insulator body 50 may include a first mating edge 57 which is configured to physically engage a flange 75 of a collar 70 that may be disposed around the first insulator body 50. Proximate or otherwise near the opposing second end, the first insulator body 50 may include a second edge 58. The first insulator body 50 may have an outer diameter that is smaller than the diameter of the opening of the outer housing 90 to allow the collar 70 to fit within the opening of the outer housing 90. Moreover, the first insulator body 50 may include an inner opening 55 extending axially from the first end 51 through the second end 52; the inner opening 55 may have various diameters at different axial points between the first end 51 and the second end 52. For example, the inner opening may be initially tapered proximate or otherwise near the first end 51 and taper inward to a constant diameter and then taper outward to a larger diameter proximate or otherwise near the second end 52. The inner opening 55 may be sized and dimensioned to accommodate a portion of an electrical contact 30, and when a coaxial cable connector 1000 is mated onto the port 100, the inner opening 55 may accommodate a portion of a center conductor 18 of a coaxial cable. Furthermore, the first insulator body 50 should be made of non-conductive, insulator materials. Manufacture of the first insulator body 50 may include casting, extruding, cutting, turning, drilling, compression molding, injection molding, spraying, or other fabrication methods that may provide efficient production of the component.

Embodiments of port 100 may also include a second insulator body 60. Embodiments of the second insulator body 60 may be a generally annular or cylindrical tubular member, and may be disposed or otherwise located within the generally axial opening of the outer housing 90, proximate or otherwise near the second end 2 of the port 100. In other words, the second insulator body 60 may be disposed within the second portion 20 of the outer housing 90. The second insulator body 60 may include a first end 61, a second end 62, an inner surface 63, and an outer surface 64. Proximate or otherwise near the first end 61, the second insulator body 60 may include a first edge 67 which is configured to physically engage a biasing member 80. For instance, the first edge 67 may be a surface of the second insulator body 60 that physically contacts the biasing member 80. Proximate or otherwise near the second end 62, the second insulator body 60 may include a second edge 68 that is configured to engage the inwardly radially extending portion 98 (e.g. a stopper) of the outer housing 90; the engagement of the second edge 86 and portion 98 can maintain a stationary position of the second insulator body 60 which provides a normal or otherwise reactant force against the biasing force of the biasing member 80 to facilitate the compression and/or biasing of the biasing member 80. The second insulator body 60 may have an outer diameter that is sized and dimensioned to fit within the opening of the outer housing 90. For example, the second insulator body 60 may be press-fit or interference fit within the opening of the outer housing 90. Moreover, the second insulator body 60 may include an inner opening 65 extending axially from the first end 61 through the second end 62; the inner opening 65 may have various diameters at different axial points between the first end 61 and the second end 62. For example, the inner opening may be initially tapered proximate or otherwise near the second end 62 and taper inward to a constant diameter and then taper outward to a larger diameter proximate or otherwise near the first end 61. The inner opening 65 may be sized and dimensioned to accommodate a portion of an electrical contact 30. Furthermore, the second insulator body 60 should be made of non-conductive, insulator materials. Manufacture of the second insulator body 60 may include casting, extruding, cutting, turning, drilling, compression molding, injection molding, spraying, or other fabrication methods that may provide efficient production of the component.

Furthermore, embodiments of port 100 may include an electrical contact 30. Embodiments of the electrical contact 30 may be a conductive element/member that may extend or carry an electrical current and/or signal from a first point to a second point. Contact 30 may be a terminal, a pin, a conductor, an electrical contact, and the like. Electrical contact 30 may include a first end 31 and an opposing second end 32. Portions of the electrical contact 30 proximate or otherwise near the first end 31 may be disposed within the inner opening 55 of the first insulator body 50 while portions of the electrical contact 30 proximate or otherwise near the second end 32 may be disposed within the inner opening 65 of the second insulator body 60. Moreover, embodiments of the electrical contact 30 may include a first socket 35*a* proximate or otherwise near the first end 31 of the contact 30 to receive, accept, collect, and/or clamp a center conductive strand 18 of a coaxial cable connector 1000. Likewise, embodiments of the electrical contact 30 may include a second socket 35*b* proximate or otherwise near the second end 32. The sockets 35*a*, 35*b* may be slotted to permit deflection to more effectively clamp and/or increase contact surface between the center conductor 18 and the socket 35*a*, 35*b*. The electrical contact 30 may be electrically isolated from the collar 75 and the conductive outer shell 90 by the first and second insulator bodies 50, 60. Embodiments of the electrical contact 30 should be made of conductive materials.

With continued reference to FIGS. 1 and 2, embodiments of the port 100 may further include a collar 70. Embodiments of the collar 70 may be a generally annular member having a generally axial opening therethrough. The collar 70 may be operably attached to the first insulator body 50. For instance, the collar 70 may be disposed around the first insulator body 50, proximate or otherwise near the first end 51. The collar 70 may be press-fit or interference fit around the first insulator body 50. Moreover, the collar 70 may include a first end 71, a second end 72, an inner surface 73, and an outer surface 74. Embodiments of the collar 70 may include a flange 75 proximate or otherwise near the first end 71; the flange 75 can be a radially inward protrusion that may extend a radial distance inward into the general axial opening of the collar 70. The flange 75 may physically engage the mating edge 57 of the first insulator body 50 while operably configured, and may prevent axial movement of the collar 70 toward the second end 2 of the port 100 that is independent of the first insulator body 50. In other words, when the collar 70 is engaged and displaced by a coaxial cable connector 1000 as the connector 100 is being threaded or otherwise inserted onto the first portion 10 of the outer housing 90, the mechanical engagement between the flange 75 of the collar 70 and the mating edge 57 of the first insulator body 50 can allow the first insulator body 50 and the collar 70 to move/slide axially within the general opening of the outer housing 90 and engage the biasing member 80. Furthermore, the collar 70 may include a mating edge 76 proximate or otherwise near the second end 72 of the collar 70. The mating edge 76 may be configured to biasingly engage the biasing member 80. Embodiments of the mating edge 76 of the collar 70 may be tapered or ramped to deflect/direct the deformation of the biasing member 80 towards the outer surface 54 of the first insulator body 50. The degree of tapering, the direction of the taper, and the presence of a tapered mating edge 76 may be utilized to alter or control the amount of spring force exerted onto the internal component(s) of the port 100. The collar 70 may be formed of metals or other conductive materials that would facilitate a rigidly formed cylindrical tubular body. Manufacture of the collar 70 may include casting, extruding, cutting, turning, drilling, knurling, injection molding, spraying, blow molding, component overmolding, or other fabrication methods that may provide efficient production of the component.

Embodiments of the port 100 may further include a biasing member 80. Embodiments of a biasing member 80 may be any component that is compressible and can exert a biasing force against an object (in a direction opposing the inward direction that the biasing member 80 is being compressed) to return to its original shape. For example, embodiments of the biasing member 80 may be a spring, a coil spring, a compression spring, a rubber gasket, one or more O-rings, rubber bushing(s), spacer(s), spring finger(s), and the like, that has a combination of rigidity and elasticity to compress/deform in a manner that exerts a biasing force against the collar 70, in particular, against the mating edge 76 of the collar 70. Furthermore, embodiments of the biasing member 80 may be disposed between the collar 70 and the second insulator body 60 within the general axial opening of the outer housing 90. For instance, the biasing member 80 may biasingly engage the collar 70 at a first end 81 of the biasing member 80 and biasingly engage the second insulator body 60 at a second end 82 of the biasing member 80. When a connector 1000 is threaded or otherwise inserted onto port 100, the biasing member 80 can compress between the collar 70 and the second insulator body 60, exerting a biasing force against the collar 70, which can ultimately force the post 1040 back into contact with the coupling member 1030 to extend electrical continuity through the connector 1000 and continue through the port 100. Additionally, the biasing of the collar 70 against the post 1040 can extend electrical continuity between the post 1040, or mating edge of the post 1046, and the collar 70. For example, a mating edge 1046 (flat face of post flange) of the post can physically contact the flat mating edge (front face of collar) of the collar 70, wherein contact is ensured due to biasing of the biasing member 80. The biasing member 80 can be formed of conductive materials, such as metals, or non-conductive materials. For example, the biasing member 80 may be made of steel, beryllium copper, stainless steel, silicone, high-carbon wire, oil-tempered carbon wire, chrome vanadium, and the like. Further still, embodiments of the biasing member 80 may include the collar 70 integrally attached such that the biasing member 80 and the collar 70 are one piece that is configured to compress in response to a connector 1000 being threaded or axially advanced onto port 100.

Figure 3:
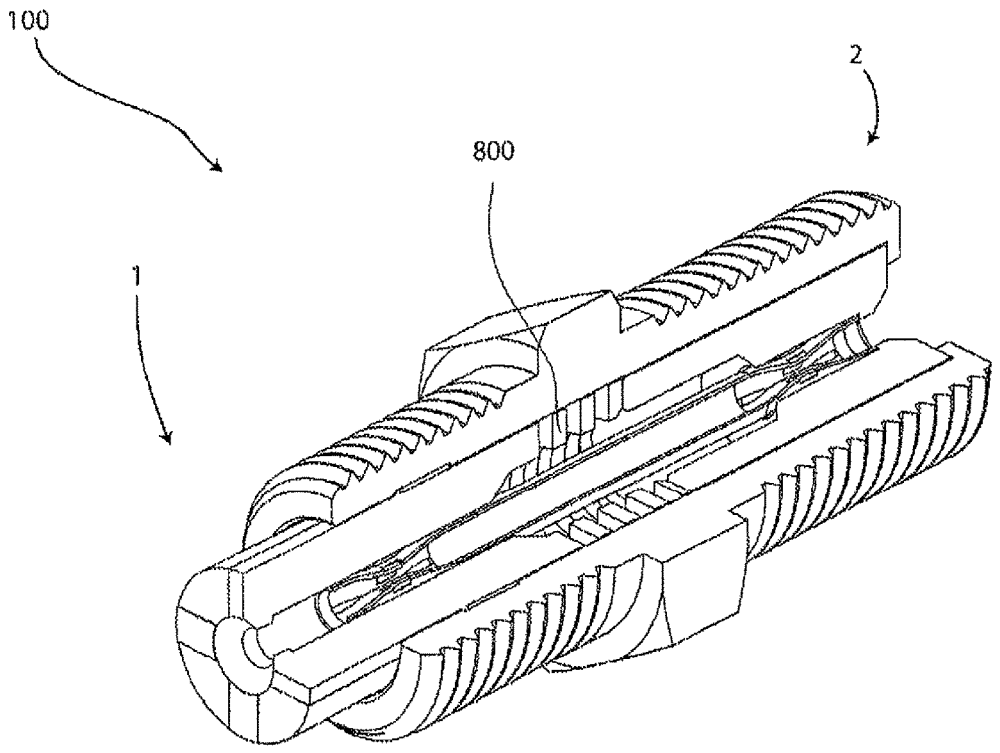
FIG. 3 depicts a cross-section view of the first embodiment of the port having an embodiment of an alternative biasing member.

Further embodiments of port 100 may not include a separate component to provide the biasing force, but rather the first insulator body 50 and/or the second insulator body 60 may include an integral biasing member. For instance, the first and/or second insulator bodies 50, 60 may include a projection of the plastic (or conductively coated plastic or conductive elastomer) that may act as biasing member. Embodiments of an integral biasing member may include the insulator body 50, 60 having an integral portion that is coiled to provide resilient properties to the insulator body 50, 60. FIG. 3 depicts an embodiment of biasing member 800, wherein metal deposition techniques are used to form an insulator having metal traces and a built in spring to provide biasing and continuity.

Figure 4:
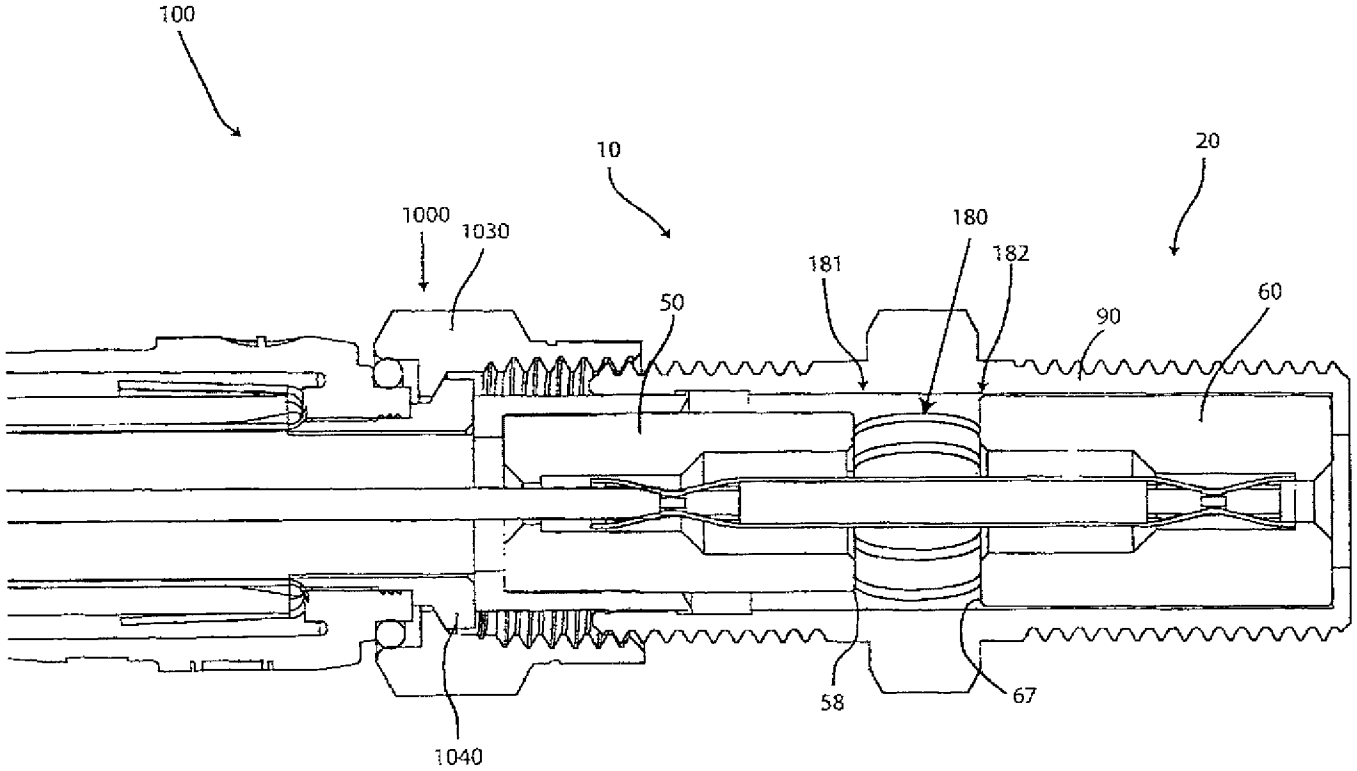
FIG. 4 depicts a cross-section view of the first embodiment of the port having an embodiment of an alternative biasing member.

Referring now to FIG. 4, embodiments of port 100 may include a biasing member 180. Embodiments of biasing member 180 may share the same or substantially the same function as biasing member 80; however, biasing member 180 may be disposed between the first insulator body 50 and the second insulator body 60, and configured to compress when a connector 1000 is threaded or otherwise inserted onto the port 100. For instance, embodiments of biasing member 180 may biasingly engage the second edge 58 of the first insulator body 50 at a first end 181 and may biasingly engage the first edge 67 of the second insulator body 60. Embodiments of biasing member 180 may be one or more resilient fingers disposed between the first and second insulator bodies 50, 60. When a connector 1000 is threaded or otherwise inserted onto port 100, the biasing member 180 can compress between the first insulator body 50 and the second insulator body 60, exerting a biasing force against the first insulator body 50, which can ultimately force the post 1040 back into contact with the coupling member 1030 to extend electrical continuity through the connector 1000 and continue through the port 100. The biasing member 180 can be formed of conductive materials, such as metals, or non-conductive materials. For example, the biasing member 80 may be made of steel, stainless steel, beryllium copper, silicone, high-carbon wire, oil-tempered carbon wire, chrome vanadium, and the like.

Figure 5:
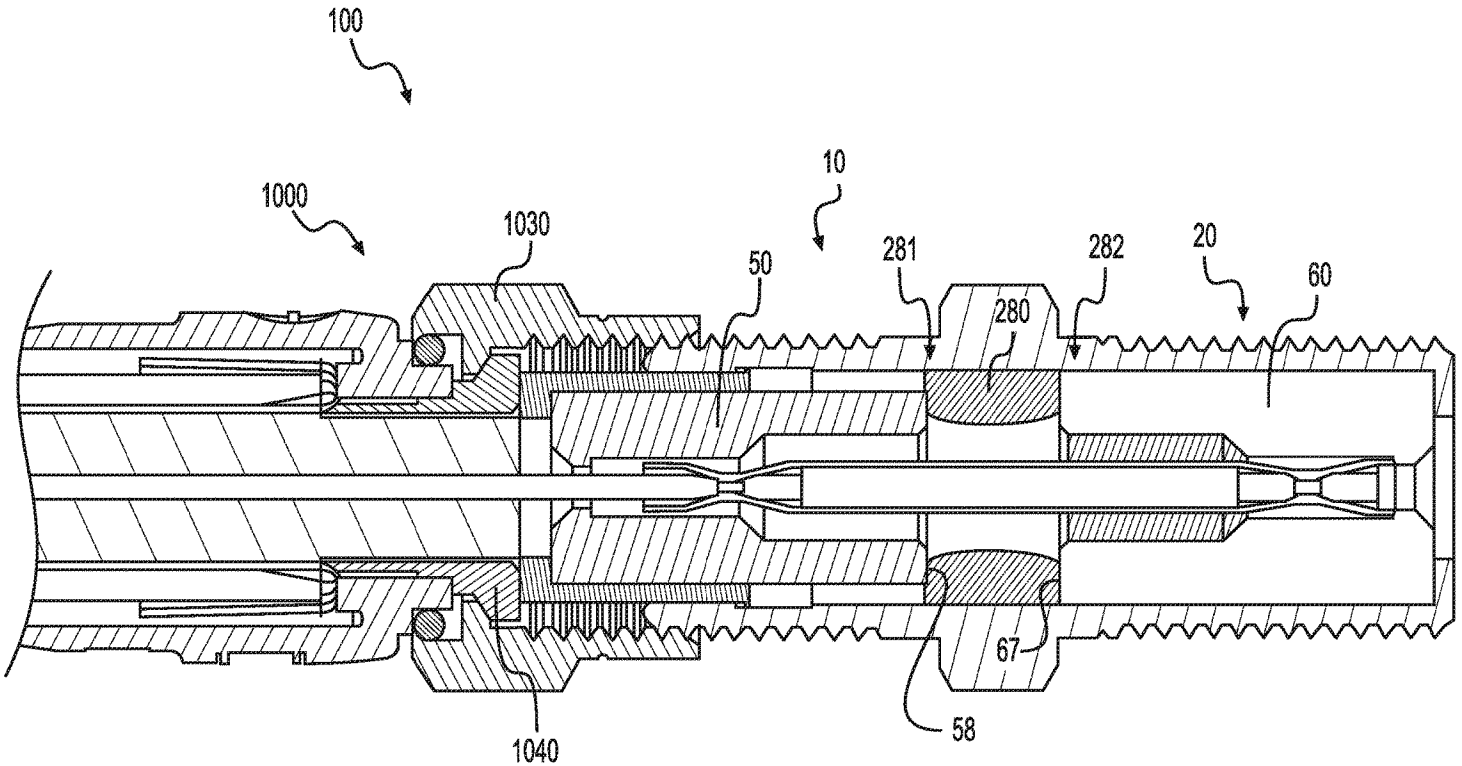
FIG. 5 depicts a cross-section view of the first embodiment of the port having an embodiment of an alternative biasing member.

With reference now to FIG. 5, embodiments of port 100 may include a biasing member 280. Embodiments of biasing member 280 may share the same or substantially the same function as biasing member 80; however, biasing member 280 may be disposed between the first insulator body 50 and the second insulator body 60, and configured to compress when a connector 1000 is threaded or otherwise inserted onto the port 100. For instance, embodiments of biasing member 280 may biasingly engage the second edge 58 of the first insulator body 50 at a first end 181 and may biasingly engage the first edge 67 of the second insulator body 60. Embodiments of biasing member 180 may be a rubber gasket, a rubber collar, or any generally cylindrical member that is elastic and can compress between the first and second insulator bodies 50, 60 and exert a biasing force against the components. When a connector 1000 is threaded or otherwise inserted onto port 100, the biasing member 280 can compress between the first insulator body 50 and the second insulator body 60, exerting a biasing force against the first insulator body 50, which can ultimately force the post 1040 back into contact with the coupling member 1030 to extend electrical continuity through the connector 1000 and continue through the port 100. The biasing member 280 should be formed of non-conductive materials, such as rubber or similarly elastic material.

Figure 7:
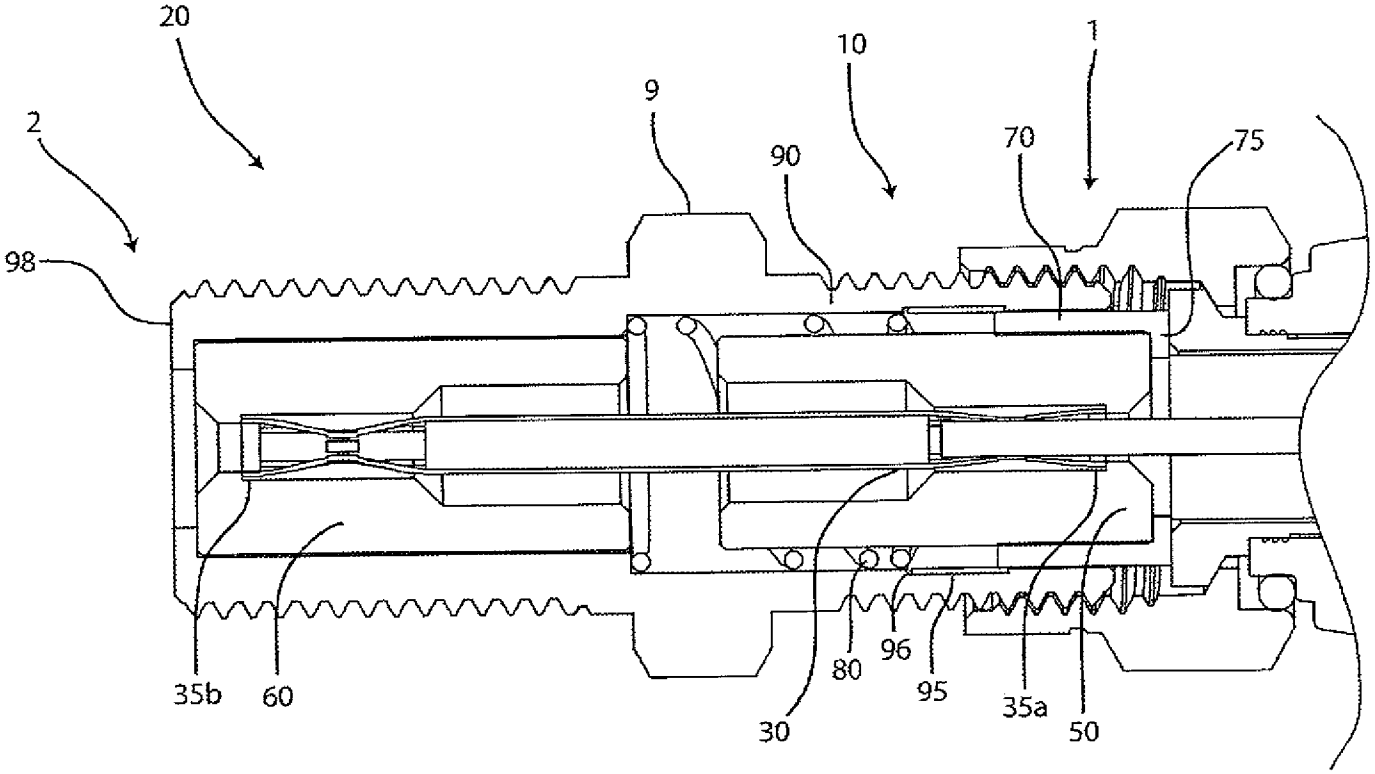
FIG. 7 depicts a cross-section view of the first embodiment of the port in a compressed or advanced position.

Referring still to the drawings, FIG. 6 depicts an embodiment of port 100 in an original, rest position. The original rest position may refer to when the connector 1000 has not contacted the port 100, and thus no deflection or compression of the components of port 100 has taken place. FIG. 7 depicts an embodiment of port 100 in a compressed position. The compressed position may refer to the position where the connector 1000 has been fully or substantially advanced onto port 100. For instance, the biasing member 80 is more compressed than in the position shown in FIG. 2, and a stronger biasing force is being exerted against the collar 70, and thus electrical continuity can be established and maintained between the post 1040 and the collar 70. In the compressed position, the post 1040 of the connector 1000 is also forced/compressed/biased against the coupling member 1030. However, those having skill in the art should appreciate that the post 1040 is biased against the coupling member 1030 prior to the fully compressed position, such as a position prior to full or substantial advancement on the port 100, as shown in FIG. 2.

With reference to FIGS. 1-7, the manner in which the port 100 extends continuity through a standard coaxial cable connector, such as connector 1000, when the connector 100 is threaded or otherwise inserted onto the port 100 will now be described. In an original position (shown in FIG. 6), the biasing member 80, 180, 280 may be in a position of rest, and the collar 70 and a portion of the first insulator body 50 may extend a distance from the first end 91 of the outer housing 90 so that the post 1040 contacts the collar 70 prior to the coupling member 1030 threadably engaging the outer housing 90, or after only a few revolutions of the coupling member 1030 onto the port 100. However, embodiments of the port 100 in the original position may include the collar 70 at various axial distances from the first end 91 of the outer housing 90, including embodiments where the collar 70 and the first insulator 50 are within the general opening of the outer housing 90 and not extending a distance from the first end 91. As a connector 1000 is initially threaded or otherwise inserted (e.g. axially advanced) onto the first portion 10 of the outer housing 90, the mating edge 1046 of the post 40 can physically engage the flange 75 of the collar 70, as shown in FIG. 2. Continuing to thread or otherwise axially advance the connector 1000 onto the port 100 can cause the collar 70 and the first insulator body 50 to displace further and further axially towards the second end 2 of the port 100 and compress the biasing member 80, 180, 280. Any compression/deformation of the biasing member 80, 180, 280 caused by the axial movement of the collar 70 and/or the first insulator body 50 results in a biasing force exerted against the collar 70 and/or the first insulator body 50 in the opposing direction while the biasing member 80, 180, 280 constantly tries to return to its original shape/rest position. The biasing force exerted onto the collar 70 and/or first insulator body 50 by the biasing member 80 transfers to a biasing force against the post 1040 in the same opposing direction (i.e. opposing the axial direction of the connector moving onto the port 100) which extends continuity between the connector 1000 and the port 100. Additionally, the biasing force exerted against the post 1040 can axially displace and/or bias the post 1040 in the same opposing direction into physical contact with the coupling member 1030. The physical contact between the post 1040 and the coupling member 1030, if the coupling member 1030 is conductive, extends electrical continuity between the post 1040 and the coupling member 1030, thereby providing a continuous grounding path through the connector 1000. The connector 1000 may be threaded or otherwise axially advanced onto the post 100 until the compressed position, as shown in FIG. 7; the biasing member 80, 180, 280 can constantly exert a biasing force while in the fully compressed position, thereby, in addition to establishing, the compressed biasing member 80, 180, 280 may maintain continuity through the connector 1000 which improves signal quality and afford improved RF shielding properties.

In another embodiment, the port 100 can extend electrical continuity through the connector 1000 and onto the port 100 without the need for collar 70. For instance, the first insulator body 50 and/or the second insulator body 60 may be formed of a conductive rubber, or conductive material may be applied to the first and second insulators 50, 60. Accordingly, contact between the conductive insulators 50, 60 and the post 1040 may extend electrical continuity therebetween. Those having skill in the art should appreciate that a conductive coating may be applied to the entire outer body, just a front face/edge, or the front face/edge and the outer surfaces of the first and second insulators 50, 60, (whichever insulator 50, 60 will contact a post of a coaxial cable connector may be conductively coated).

Figure 8:
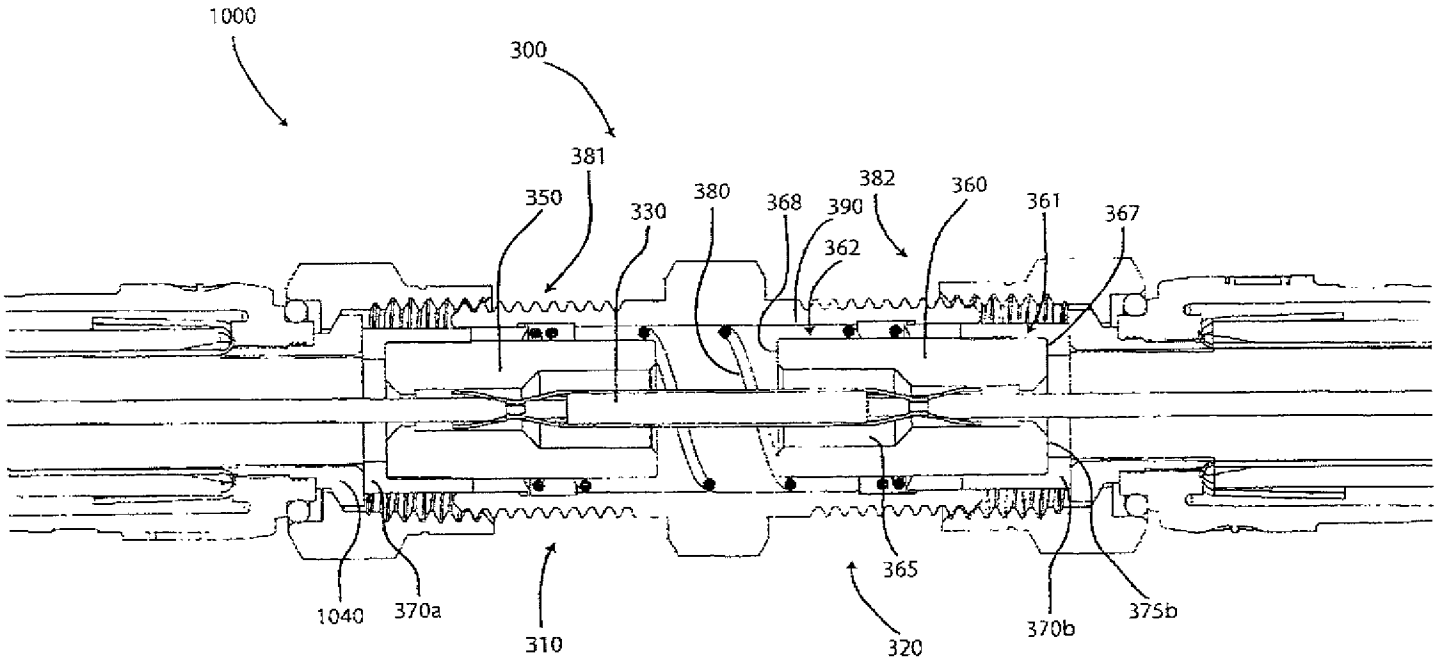
FIG. 8 depicts a cross-section view of a second embodiment of a port.

With continued reference to the drawings, FIG. 8 depicts an embodiment of port 300. Embodiments of port 300 may share the same or substantially the same structure and function as port 100. However, embodiments of port 300 can be used specifically for two-sided ports to provide continuity to two connectors, such as at a splice connection. For example, both the first and the second insulator bodies 350, 360 are moveable within the axial opening of the outer housing 390 in response to the biasing force exerted by the biasing member 380 to axially displace and/or bias the post 1040 of a connector 1000 into physical contact with the coupling member 1000 as the connector is threaded or axially advanced onto the port 300. The manner in which the port 300 provides continuity through the connector 1000 is the same or substantially the same as described above in association with port 100. Moreover, the connectors configured to be threaded or axially advanced onto the port 300 may be the same or substantially the same as connector 1000; those skilled in the art should appreciate that a connector mated onto one end of port 300 can be of a different size, quality, standard, performance level, etc. than the connector mated onto the other end of the port 300.

Embodiments of port 300 may include an outer housing 390, a first insulator body 350, a first collar 370*a*, a second insulator body 360, a second collar 370*b*, an electrical contact 330, and a biasing member 380. Embodiments of the outer housing 390, the first insulator 350, the first and second collars 370*a*, 370*b*, the electrical contact 330, and the biasing member 380 may share the same or substantially the same structure and function as the outer housing 90, the first insulator 50, the collar 70, the electrical contact 30, and the biasing member 80, 180, 280, respectively. However, embodiments of the biasing member 380 may biasingly engage the first collar 370*a* at one end 381 and a second collar 370*b* at a second end 382. Further embodiments of port 300 may include an outer housing 390 having a first portion 310 and a second portion 320, a first moveable insulator 350 disposed within the first portion 310, wherein a first collar 370*a* is operably attached to the first moveable insulator 350, a second moveable insulator 360 disposed within the second portion 320, wherein a second collar 370*b* is operably attached to the second moveable insulator 360, and a biasing member 380 disposed within the outer housing 390, the biasing member 380 biasingly engaging the first collar 370*a* and the second collar 370*b*.

However, embodiments of port 300 may include a second insulator body 360 that is moveable within the general opening of the outer housing 90, just as the first insulator body 350. For instance, the second insulator body 360 may be a generally annular or cylindrical tubular member, and may be disposed or otherwise located within the generally axial opening of the outer housing 90, proximate or otherwise near the second end 2 of the port 300. Proximate the first end 361, the second insulator body 360 may include a first mating edge 367 which is configured to physically engage a flange 375*b* of the second collar 370*b* that may be disposed around the second insulator body 360. Proximate or otherwise near the opposing second end, the second insulator body 360 may include a second edge 368. The second insulator body 360 may have an outer diameter that is smaller than the diameter of the opening of the outer housing 390 to allow the second collar 370*b* to fit within the opening of the outer housing 390. Moreover, the second insulator body 360 may include an inner opening 365 extending axially from the first end 361 through the second end 362; the inner opening 365 may have various diameters at different axial points between the first end 361 and the second end 362. For example, the inner opening may be initially tapered proximate or otherwise near the second end 362 and taper inward to a constant diameter and then taper outward to a larger diameter proximate or otherwise near the first end 361. The inner opening 365 may be sized and dimensioned to accommodate a portion of an electrical contact 330, and when a coaxial cable connector 1000 is mated onto the port 300 on the second end 2 of the port 300, the inner opening 365 may accommodate a portion of a center conductor 18 of a coaxial cable 10. Furthermore, the second insulator body 360 should be made of non-conductive, insulator materials. Manufacture of the second insulator body 360 may include casting, extruding, cutting, turning, drilling, compression molding, injection molding, spraying, or other fabrication methods that may provide efficient production of the component.

With reference to FIGS. 1-8, embodiments of a method of providing continuity through a coaxial cable connector 1000 may include the steps of providing an outer housing 90, 390 having a first end 91, 391 and a second end 92, 392, the outer housing 90, 390 configured to terminate a coaxial cable connector 1000 at one or both of a first end 91, 391 and a second end 92, 392, disposing a biasing member 80, 180, 280, 380 within the outer housing 90, 390 to bias at least one collar 70, 370*a*, 370*b* and advancing the coaxial cable connector 1000 onto the outer housing 90, 390 to bring a post 1040 of the coaxial cable connector 1000 into engagement with the at least one collar 70, 370*a*, 370*b*, wherein the engagement between the post 1040 and the at least one collar 70, 370*a*, 370*b* biases the post 1040 into a coupling member 1030 of the coaxial cable connector 1000 to extend electrical continuity through the connector 1000.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the invention, as required by the following claims. The claims provide the scope of the coverage of the invention and should not be limited to the specific examples provided herein.

What is claimed is:

1. A device for biasingly forming a first ground path between a collar portion and a post portion and biasingly forming a second ground path between the post portion and a coupler portion when a coaxial cable connector moves toward a port from a first port-engaged position to a second port-engaged position comprising:

a biasing portion configured to biasingly urge the collar portion against the post portion of the coaxial cable connector so as to biasingly form a first electrical ground path between the coaxial cable connector and the port during operation of the coaxial cable connector when the coaxial cable connector moves toward the port from the first port-engaged position to the second port-engaged position;

wherein the biasing portion is configured to biasingly urge the post portion against the coupler portion of the coaxial cable connector so as to biasingly form the second ground path between the post portion and the coupler portion when the coaxial cable connector moves toward the port from the first port-engaged position to the second port-engaged position;

wherein the collar portion includes a flange portion configured to engage the post portion of the coaxial cable connector;

wherein the biasing portion is configured to at least partially encircle a first insulator body portion;

wherein the biasing portion includes a forward end configured to be biased against the collar portion and a rearward end configured to engage a second insulator body portion;

wherein the first insulator body portion is configured to be disposed in a first portion of an outer housing and engage the flange portion;

wherein the second insulator body portion is configured to be disposed in a second portion of the outer housing;

wherein the biasing portion is configured to bias the collar portion against the post portion of the coaxial cable connector when the coaxial cable connector is moved related to the outer housing so as to biasingly form the first electrical ground path between the coaxial cable connector and the port during operation of the coaxial cable connector when the coaxial cable connector moves toward the port from the first port-engaged position to the second port-engaged position;

wherein the biasing portion is configured to bias the post portion against the coupler portion when the coaxial cable connector is moved relative to the outer housing so as to biasingly form the second ground path between the post portion and the coupler portion when the coaxial cable connector moves toward the port from the first port-engaged position to the second port-engaged position;

wherein the biasing portion comprises a biasing member, the collar portion comprises a collar member, the post portion comprises a post member, and the coupler portion comprises a coupler member;

wherein the biasing member, the collar member, the post member, and the coupler member are each separate components from one another;

wherein the collar portion, the post portion, and the coupler portion are each conductive;

wherein the biasing portion is configured to biasingly restrain axial movement of the second insulator body portion relative to the second portion of the outer housing when the coaxial cable connector moves toward the port from the first port-engaged position to the second port-engaged position;

wherein the second portion of the outer housing includes a stopper portion configured to biasingly restrain axial movement of the second insulator body portion relative to the second portion of the outer housing when the coaxial cable connector moves toward the port from the first port-engaged position to the second port-engaged position;

wherein the biasing portion is configured to biasingly urge the post portion against the coupler portion of the coaxial cable connector so as to biasingly form the second ground path between the post portion and the coupler portion when the coaxial cable connector moves toward the port from the first port-engaged position to the second port-engaged position and before the cable connector has moved to a fully tightened position on the port;

wherein the port comprises a port assembly;

wherein the port assembly includes the collar portion;

wherein the port assembly includes the first and second insulator body portions;

wherein the port assembly includes the outer housing;

wherein the outer housing is configured to at least partially encircle the collar portion; and wherein the coaxial cable connector comprises a coaxial cable connector assembly that includes the post portion and the coupler portion.

2. The device of claim 1, wherein the biasing member includes one or more resilient finger portions configured to be disposed between the first insulator body portion and the second insulator body portion such that compression of the one or more resilient fingers portion exerts a compressive force against the first insulator body portion toward a first direction and against the second insulator body portion toward a second direction different from the first direction.

3. The device of claim 1, wherein the biasing portion comprises a spring.

4. The device of claim 1, wherein the biasing portion comprises a gasket configured to be disposed between the first insulator body portion and the second insulator body portion such that compression of the gasket exerts a compressive force against the first insulator body portion in a first direction and against the second insulator body portion in a second direction different from the first direction.

5. The device of claim 1, wherein advancing the coaxial cable connector onto the outer housing is configured to exert a biasing force against the collar to contact the post, and wherein the biasing force biases the post portion into contact with the coupler portion to maintain physical and electrical contact between the post portion and the coupler portion.

6. The device of claim 1, wherein the stopper portion is a stopper surface configured to restrain axial movement of the second insulator body when the biasing member exerts a compressive force when the coaxial cable connector moves toward the port from the first port-engaged position to the second port-engaged position.

7. The device of claim 1, wherein the coaxial cable connector is configured to advance onto a portion of the outer housing, and wherein physical and electrical contact between the post portion and the coupler portion is established prior to full or substantial advancement of the coaxial cable connector.

8. A device for biasingly forming a ground path between a port and a coaxial cable connector comprising:

a biasing portion configured to biasingly urge a collar portion against a post portion of the coaxial cable connector so as to biasingly form a first ground path between the coaxial cable connector and the port during operation of the coaxial cable connector when the coaxial cable connector moves toward the port from a first port-engaged position to a second port-engaged position;

wherein the biasing portion is configured to biasingly urge the post portion against a coupler portion of the coaxial cable connector so as to biasingly form a second ground path between the post portion and the coupler portion when the coaxial cable connector moves toward the port from the first port-engaged position to the second port-engaged position;

wherein the collar portion, the post portion, and the coupler portion are each conductive;

wherein the biasing portion comprises a biasing member, the collar portion comprises a collar member, the post portion comprises a post member, and the coupler portion comprises a coupler member;

wherein the biasing member, the collar member, the post member, and the coupler member are each separate components from one another; and wherein the biasing portion is configured to biasingly push the post portion against the coupler portion of the coaxial cable connector so as to biasingly form the second ground path between the post portion and the coupler portion when the coaxial cable connector moves toward the port from the first port-engaged position to the second port-engaged position and before the coaxial cable connector has moved to a fully tightened position on the port.

9. The device of claim 8, wherein the collar portion includes a flange portion configured to engage the post portion of the coaxial cable connector.

10. The device of claim 8, wherein the biasing portion is configured to at least partially encircle a first insulator body portion.

11. The device of claim 10, wherein the biasing portion includes a forward end configured to be biased against the collar portion and a rearward end configured to engage a second insulator body portion.

12. The device of claim 11, wherein the first insulator body portion is configured to be disposed in a first portion of an outer housing and engage the flange portion.

13. The device of claim 12, wherein the second insulator body portion is configured to be disposed inside a second portion of the outer housing.

14. The device of claim 13, wherein the biasing portion is configured to bias the collar portion against the post portion of a coaxial cable connector when the coaxial cable connector is moved relative to the outer housing so as to biasingly form the first electrical ground path between the coaxial cable connector and the port during operation of the coaxial cable connector when the coaxial cable connector moves toward the port from the first port-engaged position to the second port-engaged position.

15. The device of claim 13, wherein the biasing portion is configured to bias the post portion against the coupler portion when the coaxial cable connector is moved relative to the outer housing so as to biasingly form the second ground path between the post portion and the coupler portion when the coaxial cable connector moves toward the port from the first port-engaged position to the second port-engaged position.

16. The device of claim 13, wherein the biasing portion is configured to biasingly restrain axial movement of the second insulator body portion relative to the second portion of the outer housing when the coaxial cable connector moves toward the port from the first port-engaged position to the second port-engaged position.

17. The device of claim 13, wherein the second portion of the outer housing includes a stopper portion configured to biasingly restrain axial movement of the second insulator body portion relative to the second portion of the outer housing when the coaxial cable connector moves toward the port from the first port-engaged position to the second port-engaged position.

18. The device of claim 17, wherein the stopper portion is a stopper surface configured to restrain axial movement of the second insulator body portion when the biasing portion exerts a compressive force when the coaxial cable connector moves toward the port from the first port-engaged position to the second port-engaged position.

19. The device of claim 12, wherein the port comprises a port assembly that includes the outer housing.

20. The device of claim 19, wherein the outer housing is configured to at least partially encircle the collar portion.

21. The device of claim 12, wherein the coaxial cable connector is configured to advance onto a portion of the outer housing, and wherein physical and electrical contact between the post portion and the coupler portion is established prior to full or substantial advancement of the coaxial cable connector.

22. The device of claim 12, wherein the outer housing is configured to at least partially house the collar portion and the first and second insulator body portions, wherein the housing includes a radially inwardly projecting portion configured to restrain axial movement of the second insulator body portion when the biasing portion exerts a biasing force against it.

23. The device of claim 11, wherein the biasing member includes a resilient finger portion configured to be disposed between the first insulator body portion and the second insulator body portion such that compression of the finger portion exerts a compressive force against the first insulator body portion toward a first direction and against the second insulator body portion toward a second direction different from the first direction.

24. The device of claim 11, wherein the biasing portion comprises a gasket configured to be disposed between the first insulator body portion and the second insulator body portion such that compression of the gasket exerts a compressive force against the first insulator body portion in a first direction and against the second insulator body portion in a second direction different from the first direction.

25. The device of claim 10, wherein the biasing force exerted against the first insulator body portion is transferred to the post portion so as to bias the post portion into contact with the coupler portion to maintain physical and electrical contact between the coupler portion and the post portion.

26. The device of claim 8, wherein the biasing portion comprises a spring.

27. The device of claim 8, wherein the port comprises a port assembly.

28. The device of claim 27, wherein the port assembly includes the collar portion.

29. The device of claim 8, wherein the coaxial cable connector comprises a coaxial cable connector assembly that includes the post portion and the coupler portion.

30. The device of claim 27, wherein the port assembly includes the first and second insulator body portions.

31. The device of claim 8, wherein advancing the coaxial cable connector onto the outer housing is configured to exert a biasing force against the collar portion to contact the post portion, and wherein the biasing force biases the post portion into contact with the coupler portion to maintain physical and electrical contact between the post portion and the coupler portion.

32. A device for biasingly forming a ground path between a port and a coaxial cable connector comprising:

a biasing portion configured to biasingly urge a collar portion against a post portion of the coaxial cable connector so as to biasingly form a first electrical ground path between the coaxial cable connector and the port during operation of the coaxial cable connector when the coaxial cable connector moves toward the port from a first port-engaged position to a second port-engaged position;

wherein the biasing portion is configured to biasingly urge the post portion against a coupler portion of the coaxial cable connector so as to biasingly form a second ground path between the post portion and the coupler portion when the coaxial cable connector moves toward the port from the first port-engaged position to the second port-engaged position; and wherein the collar portion, the post portion, and the coupler portion are each conductive.

33. The device of claim 32, wherein the collar portion includes a flange portion configured to engage the post portion of the coaxial cable connector.

34. The device of claim 32, wherein the biasing portion is configured to at least partially encircle a first insulator body portion.

35. The device of claim 34, wherein the biasing portion includes a forward end configured to be biased against the collar portion and a rearward end configured to engage a second insulator body portion.

36. The device of claim 35, wherein the first insulator body portion is configured to be disposed in a first portion of an outer housing and engage the flange portion.

37. The device of claim 36, wherein the second insulator body portion is configured to be disposed inside a second portion of the outer housing.

38. The device of claim 37, wherein the biasing portion is configured to bias the collar portion against the post portion of a coaxial cable connector when the coaxial cable connector is moved relative to the outer housing so as to biasingly form the first electrical ground path between the coaxial cable connector and the port during operation of the coaxial cable connector when the coaxial cable connector moves toward the port from the first port-engaged position to the second port-engaged position.

39. The device of claim 37, wherein the biasing portion is configured to bias the post portion against the coupler portion when the coaxial cable connector is moved relative to the outer housing so as to biasingly form the second ground path between the post portion and the coupler portion when the coaxial cable connector moves toward the port from the first port-engaged position to the second port-engaged position.

40. The device of claim 37, wherein the biasing portion is configured to biasingly restrain axial movement of the second insulator body portion relative to the second portion of the outer housing when the coaxial cable connector moves toward the port from the first port-engaged position to the second port-engaged position.

41. The device of claim 37, wherein the second portion of the outer housing includes a stopper portion configured to biasingly restrain axial movement of the second insulator body portion relative to the second portion of the outer housing when the coaxial cable connector moves toward the port from the first port-engaged position to the second port-engaged position.

42. The device of claim 36, wherein the port comprises a port assembly that includes the outer housing.

43. The device of claim 42, wherein the outer housing is configured to at least partially encircle the collar portion.

44. The device of claim 43, wherein the coaxial cable connector comprises a coaxial cable connector assembly that includes the post portion and the coupler portion.

45. The device of claim 36, wherein the coaxial cable connector is configured to be advanced onto the outer housing when the coaxial cable connector is coupled to the port.

46. The device of claim 36, wherein the biasing portion is configured to biasingly maintain the electrical contact between the post portion and the coupler portion before the coaxial cable connector is fully or substantially advanced onto the outer housing.

47. The device of claim 36, wherein the outer housing is configured to at least partially house the collar portion.

48. The device of claim 36, wherein the outer housing has a first portion and a second portion, wherein the first portion is configured to at least partially house the collar portion.

49. The device of claim 48, wherein the second portion is configured to at least partially house the second insulator body portion.

50. The device of claim 36, wherein the coaxial cable connector is configured to be advanced onto the outer housing.

51. The device of claim 35, wherein the biasing member includes a resilient finger portion configured to be disposed between the first insulator body portion and the second insulator body portion such that compression of the finger portion exerts a compressive force against the first insulator body portion toward a first direction and against the second insulator body portion toward a second direction different from the first direction.

52. The device of claim 35, wherein the biasing portion comprises a gasket configured to be disposed between the first insulator body portion and the second insulator body portion such that compression of the gasket exerts a compressive force against the first insulator body portion in a first direction and against the second insulator body portion in a second direction different from the first direction.

53. The device of claim 35, wherein the outer housing includes a stopper configured to restrain axial movement of the second insulator body portion when the biasing portion exerts a biasing force at the second end.

54. The device of claim 32, wherein the biasing member biasingly maintains the post portion and the coupler portion of the coaxial cable connector in electrical contact with one another during operation of the coaxial cable connector.

55. The device of claim 32, wherein the biasing portion comprises a biasing member, the collar portion comprises a collar member, the post portion comprises a post member, and the coupler portion comprises a coupler member.

56. The device of claim 55, wherein the biasing member, the collar member, the post member, and the coupler member are each separate components from one another.

57. The device of claim 32, wherein the biasing portion comprises a spring.

58. The device of claim 32, wherein the biasing portion is configured to biasingly push the post portion against the coupler portion of the coaxial cable connector so as to biasingly form the second ground path between the post portion and the coupler portion when the coaxial cable connector moves toward the port from the first port-engaged position to the second port-engaged position and before the cable connector has moved to a fully tightened position on the port.

59. The device of claim 32, wherein the port comprises a port assembly.

60. The device of claim 59, wherein the port assembly includes the collar portion.

61. The device of claim 59, wherein the port assembly includes the first and second insulator body portions.

62. The device of claim 32, wherein the first end of the biasing portion is configured to exert a biasing force from the collar portion to the post portion of the coaxial cable connector when the coaxial cable connector is coupled to the port so as to biasingly maintain physical and electrical contact between the post portion and the coupler portion of the coaxial cable connector during operation of the coaxial cable connector coupled to the port.

63. The device of claim 35, wherein the second insulator body portion contacts the biasing portion at one end and a radially inwardly extending surface at another end, the radially inwardly extending surface is configured to restrain axial movement of the second insulator body portion when the biasing portion exerts a biasing force against it.

* * * * *